US010993516B2

(12) United States Patent
Pineiro et al.

(10) Patent No.: US 10,993,516 B2
(45) Date of Patent: May 4, 2021

(54) CRAYON CONTAINER

(71) Applicant: CRAYOLA, LLC, Easton, PA (US)

(72) Inventors: Luis Rodrigo Pineiro, Bethlehem, PA (US); Thomas R. Rau, Easton, PA (US); Anthony P. Monzo, Easton, PA (US)

(73) Assignee: CRAYOLA, LLC, Easton, PA (US)

( * ) Notice: Subject to any disclaimer, the term of this patent is extended or adjusted under 35 U.S.C. 154(b) by 84 days.

(21) Appl. No.: 16/270,994

(22) Filed: Feb. 8, 2019

(65) Prior Publication Data

US 2019/0246759 A1 Aug. 15, 2019

Related U.S. Application Data

(60) Provisional application No. 62/628,729, filed on Feb. 9, 2018.

(51) Int. Cl.

| | |
|---|---|
| ***A45C 11/34*** | (2006.01) |
| ***B43L 23/08*** | (2006.01) |
| *B43K 19/00* | (2006.01) |

(52) U.S. Cl.

CPC ..... *A45C 11/34* (2013.01); *B43L 23/08* (2013.01); *B43K 19/00* (2013.01)

(58) Field of Classification Search

CPC ..... A45C 11/34; A45C 13/005; B43L 23/08; B43K 19/00

USPC ..... 206/214

See application file for complete search history.

(56) References Cited

U.S. PATENT DOCUMENTS

| | | | | |
|---|---|---|---|---|
| 2,532,725 | A * | 12/1950 | Laier | B65D 71/0003 206/168 |
| 4,815,622 | A * | 3/1989 | Cramer | B65D 21/00 220/4.21 |
| 2002/0092786 | A1* | 7/2002 | Shu | B25H 3/003 206/379 |
| 2003/0192808 | A1* | 10/2003 | Clarizio | G11B 9/14 206/575 |
| 2006/0189954 | A1* | 8/2006 | Kudo | A61F 13/536 604/380 |
| 2008/0190788 | A1* | 8/2008 | Cziraky | B43M 99/00 206/214 |
| 2018/0303212 | A1* | 10/2018 | Sandy-Hanson | A45C 11/34 |

* cited by examiner

*Primary Examiner* — Steven A. Reynolds

(74) *Attorney, Agent, or Firm* — Shook, Hardy & Bacon LLP

(57) ABSTRACT

A writing utensil container formed from a single plastic mold, including a container front panel, a front bottom component, a container back panel, a back bottom component, and a container lid component. A bottom integral hinge component may pivotally couple the back bottom component and the front bottom component, allowing the container front and back panels to pivot toward and away from each other. A lid integral hinge component may pivotally couple to the container back panel with the container lid component for opening and closing thereof. The container front and back panels may have coupling mechanisms that selectively engage with each other to prevent pivoting about the bottom integral hinge component to retain crayon boxes between the container front and back panels. A front closure feature of the front panel may selectively engage with a lid closure feature for selectively retaining the container lid component in a closed position.

17 Claims, 21 Drawing Sheets

CRAYON CONTAINER

CROSS-REFERENCE TO RELATED APPLICATIONS

This non-provisional patent application claims priority benefit to U.S. Provisional Patent Application No. 62/628,729, entitled "Crayon Container" filed on Feb. 9, 2018, and incorporated by reference herein in its entirety.

BACKGROUND

Traditional cardboard crayon boxes are not very durable and break down in response to manual manipulation, upon repeated opening and closing, and when exposed to liquids. Once enough of the crayons therein are mostly used up or lost, the box is usually tossed in the trash. The portion of partially-used crayons that are left typically get haphazardly tossed into some catch-all container, where the desired crayon color is often difficult to find under the pile of crayons therein. These crayons also tend to freely roll around in the container during transport, creating a greater probability that the crayons will break into smaller and more difficult-to-hold pieces. Thus, there is a need for a crayon container that overcomes the disadvantages of the prior art.

SUMMARY

Embodiments of the invention are defined by the claims below, not this summary. This high-level overview of various aspects of the invention disclosure introduces a selection of concepts that are further described below in the detailed description. This summary is not intended to identify key features or essential features of the claimed subject matter, nor is it intended to be used as an aid in isolation to determine the scope of the claimed subject matter.

In brief and at a high level, this disclosure describes, among other things, a writing utensil molded container, such as a plastic crayon case configured to enclose a plurality of crayons. In some aspects, the molded container is a unitary molded structure that utilizes integral hinge components such as "living" hinges integrated into the injection-molded plastic body of the crayon case as a means to transform the molded structure from a first configuration into a second configuration. In further aspects, the hinged feature of the assembled crayon case may be utilized for opening and closing access to an internal compartment of the assembled crayon case body. One of skill in the art will recognize that "living" hinge is a term of art for a hinge formed from a consistent material between a first portion of a molded material and a second portion of the molded material. In some aspects, it has a different density than at least one of the first and second portion of the molded material. A "living" hinge or integral hinge component (used interchangeably herein) is moveable and retains its shape and is molded at the same time as the adjacent portions while retaining the ability to move.

In some aspects, the molded container is a unitary molded structure injection molded in a first configuration with multiple panels. The multiple panels are oriented with respect to each other for subsequent assembly into a utensil-holding container with an internal cavity for receiving crayons or other writing utensils. The injection-molded unitary structure of the crayon case may include assembly tab structures for removable or nonremovable coupling to another portion of the unitary structure. For example, the crayon case may include tab structures for joining a front panel of a crayon case box to a back panel of a crayon case box. Similarly, the back panel of the crayon case box may include openings and/or detents for receiving the tab structures, thereby securing the crayon case box in a particular folded orientation. Thus, the molded container may be molded from a single molded material having each portion of the molded container and then oriented so that a front panel is in a first plane, a second panel is in a second plane parallel to the first plane, and a lid is hingedly integrated with the second panel so that it can pivot into a position having portions of the lid in the same plane as the first panel and in the same plane as the second panel.

In another aspect, the injection-molded body of the crayon case may include a container lid, such as a crayon case lid hingedly coupled to the enclosure portion of the box. Such container lid may be hinged at an upper edge of the crayon case, or may be hinged at a position separate from the upper edge of the crayon case, as in a traditional 64-count hinged-lid box of crayons. In further aspects, the crayon case may have an angled lid and/or opening corresponding to a profile of a received crayon box, such as a sleeve of crayons from a 32-count, 48-count, or 64-count box of crayons. In such embodiments, the sleeve structure may be seated inside the internal cavity of the crayon container to secure the crayons in an upright position and in an orientation protected by both the cardboard crayon sleeve and the outer, plastic crayon case.

In one aspect, the crayon case body may include an internal cavity with a volume corresponding to a finished crayon box and its contents. The internal cavity of the crayon case body may include a base compartment and a lid compartment assembled from the unitary molded crayon case structure. A panel of the crayon case body may include an aperture for accessing a crayon sharpening mechanism coupled to the enclosed cardboard crayon package, and/or may include an aperture for viewing features of the cardboard crayon package. Further aspects of the internal cavity are oriented to position multiple crayon positioning sleeves in an upright position inside the cavity, such as an internal cavity of the crayon case body that can fit multiple adjacent crayon sleeves in adjacent positions for the user to view all enclosed crayons.

Embodiments of the invention also include a kit containing the crayon container, and a box of crayons and/or sleeve of crayons corresponding to the interior cavity of the crayon container, where the lid portion of the crayon container may be configured to move from a closed position to an open position. Further, in the open position, the crayon container may form a support stand for securing the crayons at a particular upright use angle. While some aspects of the crayon case structure are presented as having a particular number of crayons or corresponding to a particular crayon configuration, as will be understood, the crayon container formed from a unitary injection-molded plastic structure may be constructed in such a way as to enclose any desired art material, such as a plurality of crayon bodies, in a particular position. Still further, the single, unitary molding of the crayon container may include all components of a complete crayon-holding structure, such as the front panel, back panel, side panels, top panel, bottom panel, closure mechanism for maintaining a lid of the case in a selectively openable position, locking mechanisms for securing the front panel and back panel together to form a cavity, an opening for access to a crayon sharpener, integrated molding for labeling and/or branding corresponding to exterior labeling/branding of the enclosed crayon package, and joints (i.e., "living hinges") between moveable portions of the various panel surfaces.

DESCRIPTION OF THE DRAWINGS

Illustrative embodiments of the invention are described in detail below with reference to the attached drawing figures, and wherein.

DETAILED DESCRIPTION

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention include, among other things, a writing utensil container kit 10 having a molded container 12, a plurality of writing utensils 14, and a disposable container 16 for holding the writing utensils 14 therein and fitting within the molded container 12, as shown in FIGS. 1-3 and 33. The molded container 12 may be configured for enclosing art materials and writing utensils 14 therein such as markers, crayons, twistable crayons, pastels, colored pencils, pens, chalk, and other art materials. The writing utensils 14 may be stored in the molded container 12 individually or in one or more of the disposable container 16. For example, disposable containers such as cardboard boxes or paperboard sleeves of crayons may be placed inside of the molded container 12, providing a more durable and reusable holder for crayons therein.

Figure 30:
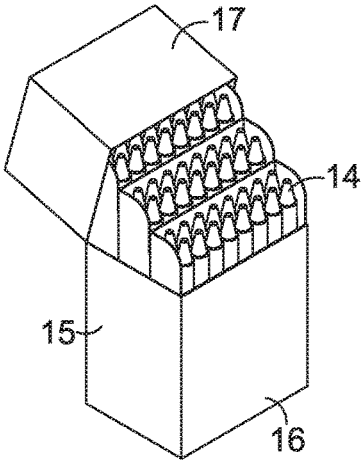
FIG. 30 is a perspective view of an exemplary writing utensil disposable container with forty-eight crayons therein.
Figure 31:
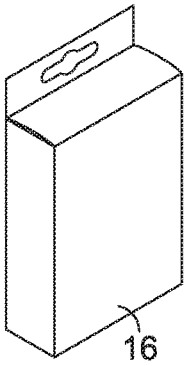
FIG. 31 is a perspective view of an exemplary writing utensil disposable container with sixteen crayons therein.
Figure 32:
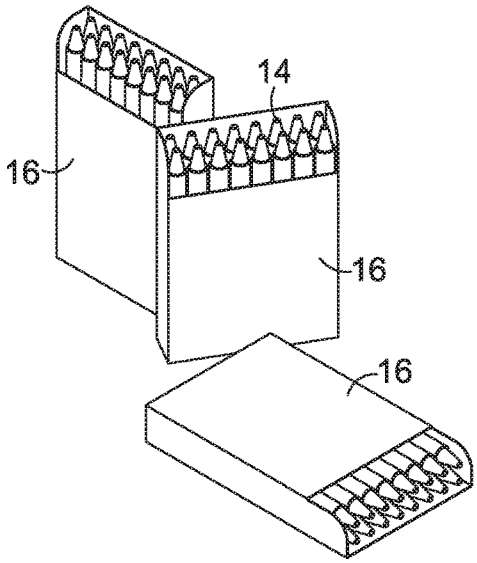
FIG. 32 is a perspective view of a plurality of writing utensil sleeves to be secured within the molded container described herein.
Figure 33:
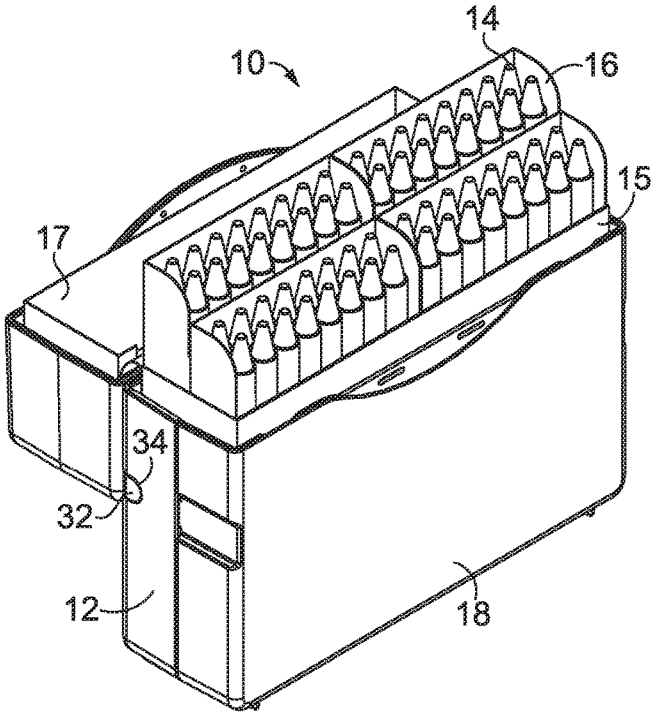
FIG. 33 is a perspective view of the writing utensil container kit of FIG. 1 with a container lid component retracted into an easel position for supporting the writing utensils in an accessible orientation, according to some aspects of the invention.

As illustrated in FIGS. 29-33, the disposable container 16 for holding the writing utensils 14 may be made of cardboard, disposable plastic, paper, or other such materials known in the art and may comprise a body 15 in which the writing utensils 14 may reside and a lid 17 pivotally connected to the body 15 by a folded portion of the disposable container 16 (e.g., a foldable segment of molded material) along the joint between the lid 17 and the body 15. In some embodiments, the disposable container 16 may be sized and shaped to hold sixty-four crayons. In some embodiments, the sixty-four crayons may be further divided therein into four sleeves of sixteen crayons, with or without a stadium configuration in which some of the sleeves are elevated slightly higher than the other sleeves of crayons, as illustrated in FIGS. 1-2, 29, and 33. In other embodiments, as illustrated in FIGS. 30-32, the disposable container 16 may be sized and shaped to hold sixteen crayons, thirty-two crayons, forty-eight crayons, or a plurality of sleeves of sixteen crayons. Other sizes and configurations, such as forty-eight count crayon boxes, may be used without departing from the scope of the invention.

The molded container 12, as illustrated in FIGS. 1-20 may comprise a unitary molded structure having multiple panels that are manipulated from a molded orientation, into an assembled orientation. The molded container may be made of plastic, plastic alternatives, or other moldable materials. In some embodiments, plastics of multiple colors may be placed in the mold for various decorative styles, including tie-dye patterns or the like. Other materials may also be embedded within the molded plastic for decorative effect or structural integrity without departing from the scope of the invention. Furthermore, embodiments disclosed herein may be injection molded from a single shot and styled to include any external features during molding for product identification using standard plastic decoration methods. In some alternative embodiments, as illustrated in FIGS. 21-28, a molded container 12*a* is depicted as substantially identical to molded container 12, but sized and configured to hold a smaller number of writing utensils 14.

The molded container 12 may specifically include a container front panel 18, a container back panel 20, a front bottom component 22, a back bottom component 24, and a container lid component 26, as shown in FIGS. 3-20. The molded container 12 may further include a plurality of hinges 28, 30, such as a bottom integral hinge component 28 and a lid integral hinge component 30, each formed by a segment of the molded container 12 having a particular density along the axis of the segment, such as a foldable segment of molded material between two panels or portions of the molded container 12 as later described herein. The molded container 12 may also include at least one front coupling mechanism 32 and at least one back coupling mechanism 34 configured to selectively coupe, engage, or interlock with the at least one front coupling mechanism 32, as well as at least one front closure feature 36 and at least one lid closure feature 38 configured to couple, engage, or interlock with the at least one front closure feature 36, as later described herein.

Figure 3:
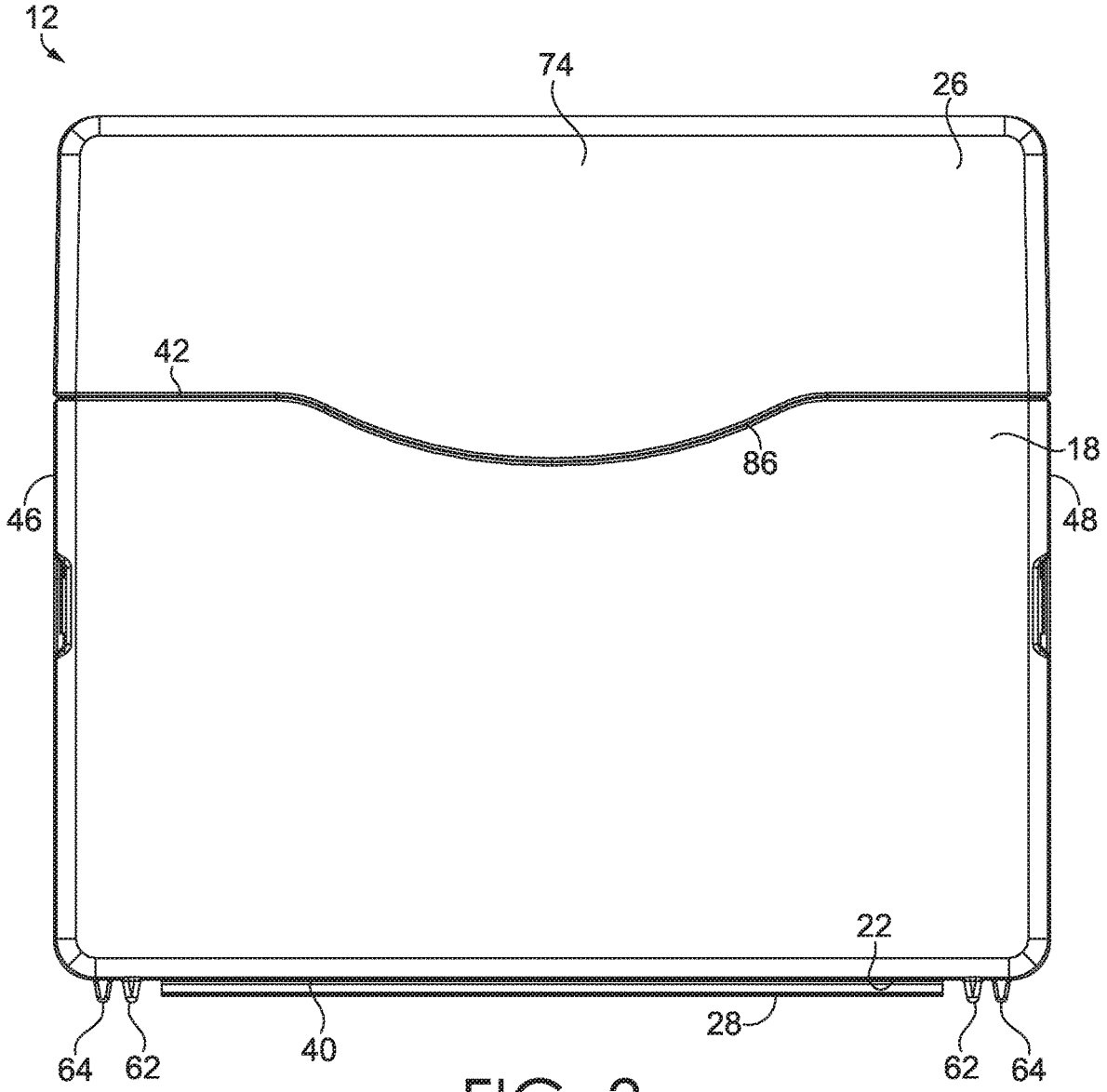
FIG. 3 is a front view of the molded container of FIG. 1 in a closed position and a retaining configuration, according to some aspects of the invention.

The container front panel 18 can be a thin, substantially-rigid plastic panel having a bottom edge 40, a top edge 42 opposite the bottom edge 40, and two opposing side edges 46,48 extending between the top and bottom edges 42,40, as shown in FIG. 3. The container front panel 18 can be integral with and formed at an angle relative to the front bottom component 22. For example, the bottom edge 40 of the container front panel 18 can form a substantially 90-degree angle with the front bottom component 22. Furthermore, the container front panel 18 can be integrally formed with the at least one front coupling mechanism 32 at one or both of the side edges 46, 48 of the container front panel 18. Likewise, the container front panel 18 can be integrally formed with the at least one front closure feature 36 at or proximate to the top edge 42 of the container front panel 18.

Figure 4:
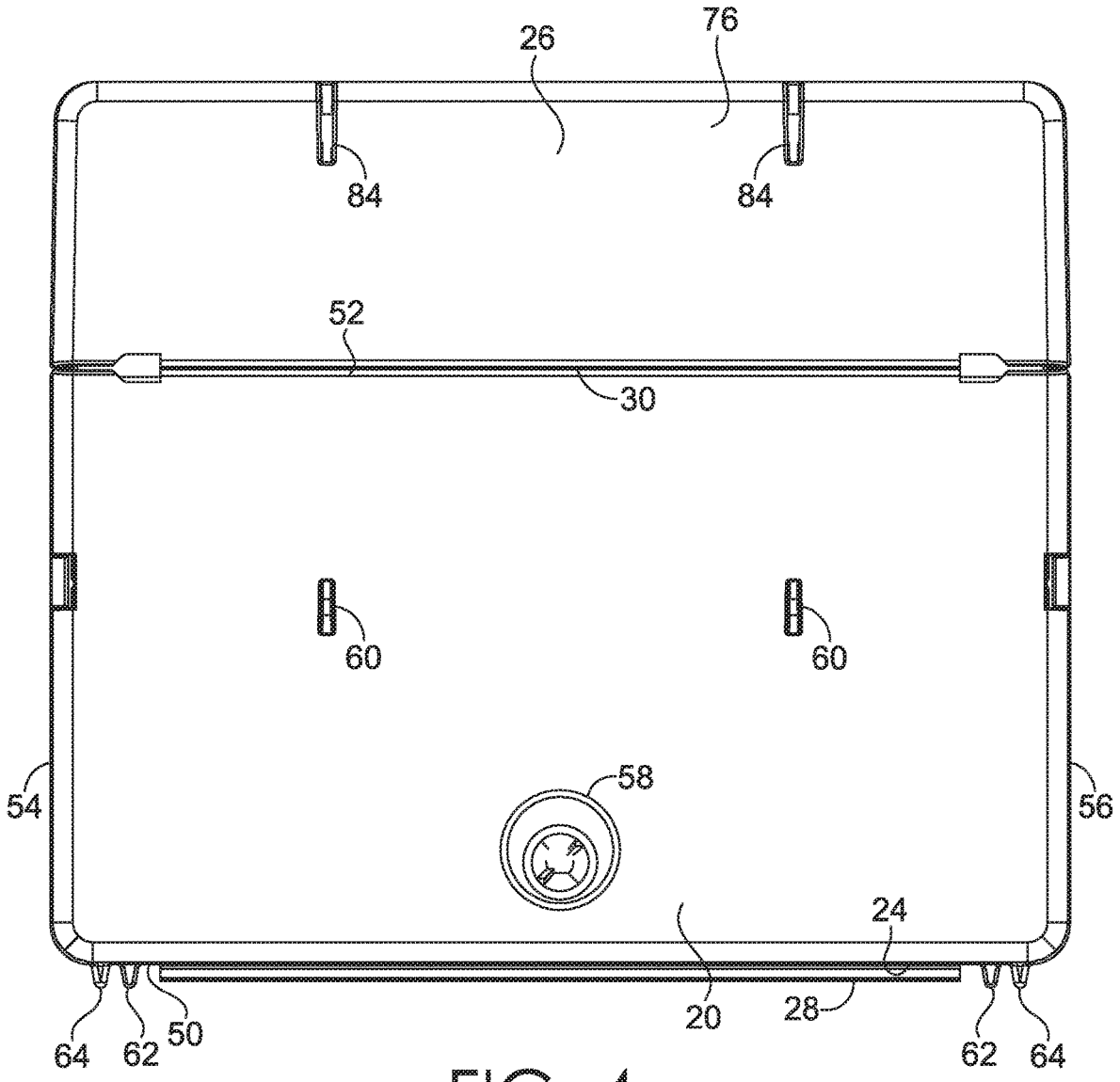
FIG. 4 is a back view of the molded container of FIG. 3.
Figure 5:
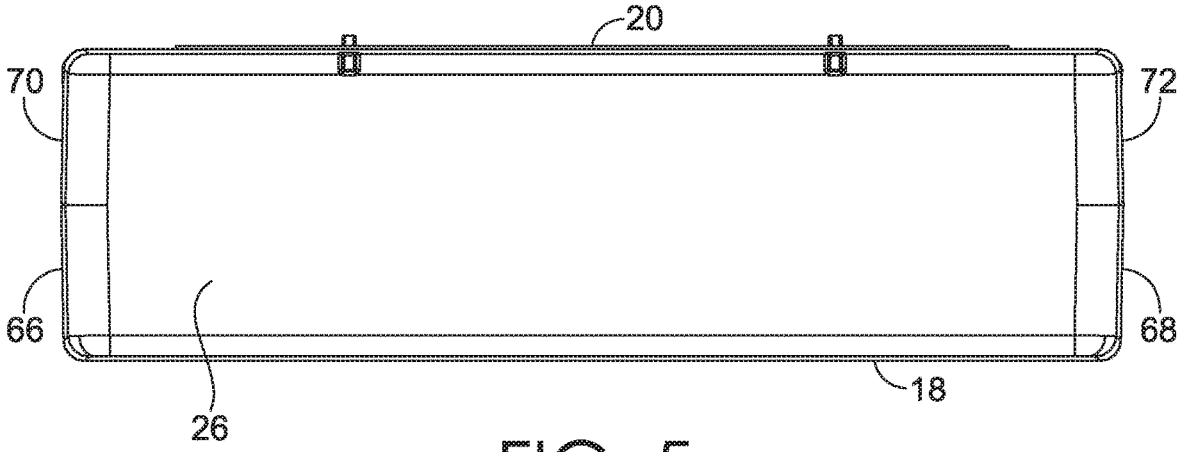
FIG. 5 is a top view of the molded container of FIG. 3.

The container back panel 20, as shown in FIG. 4, can be a thin, substantially-rigid plastic panel having a bottom edge 50, a top edge 52 opposite the bottom edge 50, and two opposing side edges 54,56 extending between the bottom and top edges 50,52. The container back panel 20 can be integral with and formed at an angle relative to the back bottom component 24. For example, the bottom edge 50 of the container back panel 20 may form a substantially 90-degree angle with the back bottom component. Furthermore, the container back panel 20 may be integrally formed with the at least one back coupling mechanism 34 at one or both of the side edges of the container back panel. The container back panel 20 may be integrally formed with one of the hinges 28, 30, as later described herein, pivotally coupling the top edge 52 of the container back panel 20 with the container lid component 26.

In some embodiments, the container back panel 20 may have at least one hole/aperture 58 formed therethrough and positioned to align with a crayon-sharpener opening in a crayon box to be inserted in the molded container, thus allowing access to the crayon-sharpener without removing the crayon box or disposable container from the molded container. Likewise, the container back panel 20 may have additional apertures (not shown) formed therethrough such that instructions, labeling, bar codes, or other desired information on the disposable container 16 therein can be viewed therethrough when inserted into the molded container 12. Furthermore, the container back panel 20 may have hold-open features 60 such as indentions formed therein or apertures formed therethrough for receiving and/or retaining portions of the container lid component 26 in an open position, as later described herein. Conversely, the container back panel 20 may have protrusions extending therefrom and configured for insertion into indentions or holes of the container lid component 26 in the open position, as later described herein.

Figure 6:
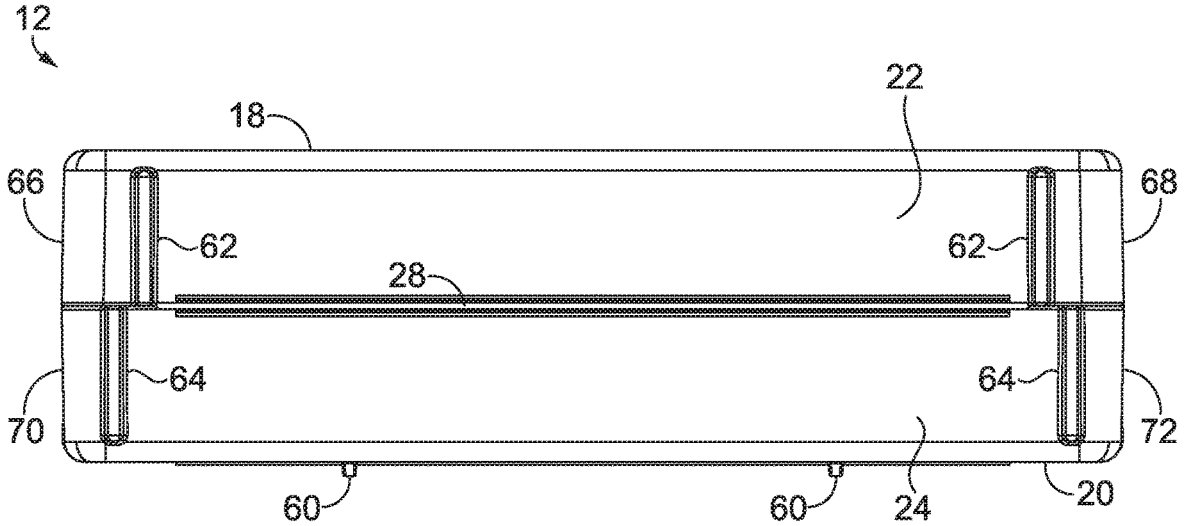
FIG. 6 is a bottom view of the molded container of FIG. 3.
Figure 7:
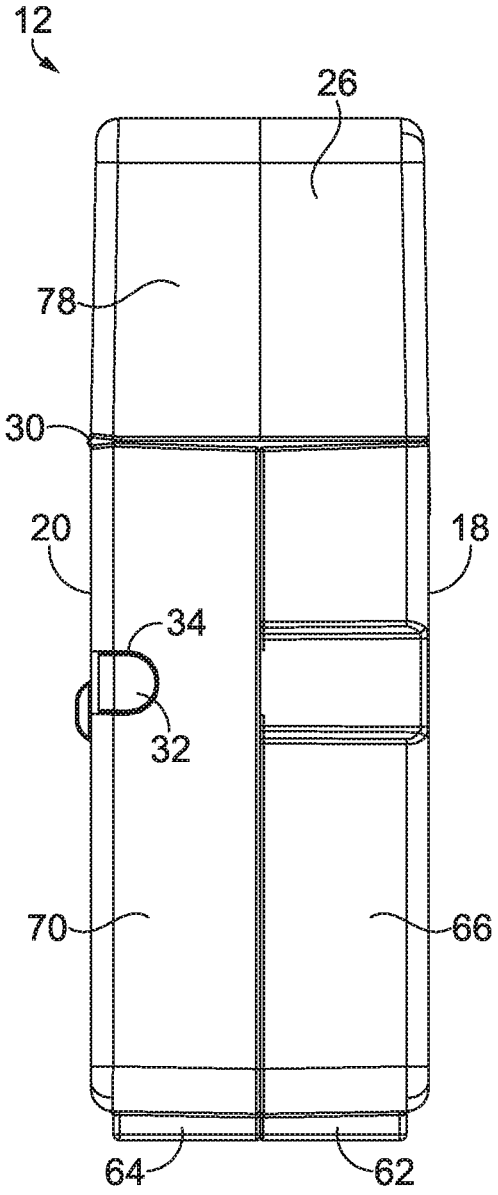
FIG. 7 is first side view of the molded container of FIG. 3.
Figure 8:
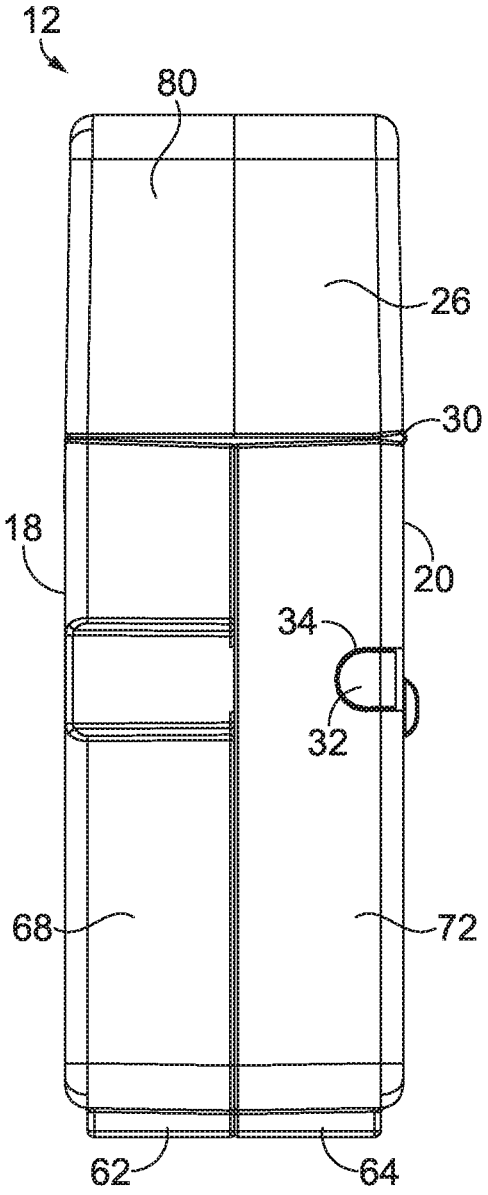
FIG. 8 is a second side view of the molded container of FIG. 3.
Figure 9:
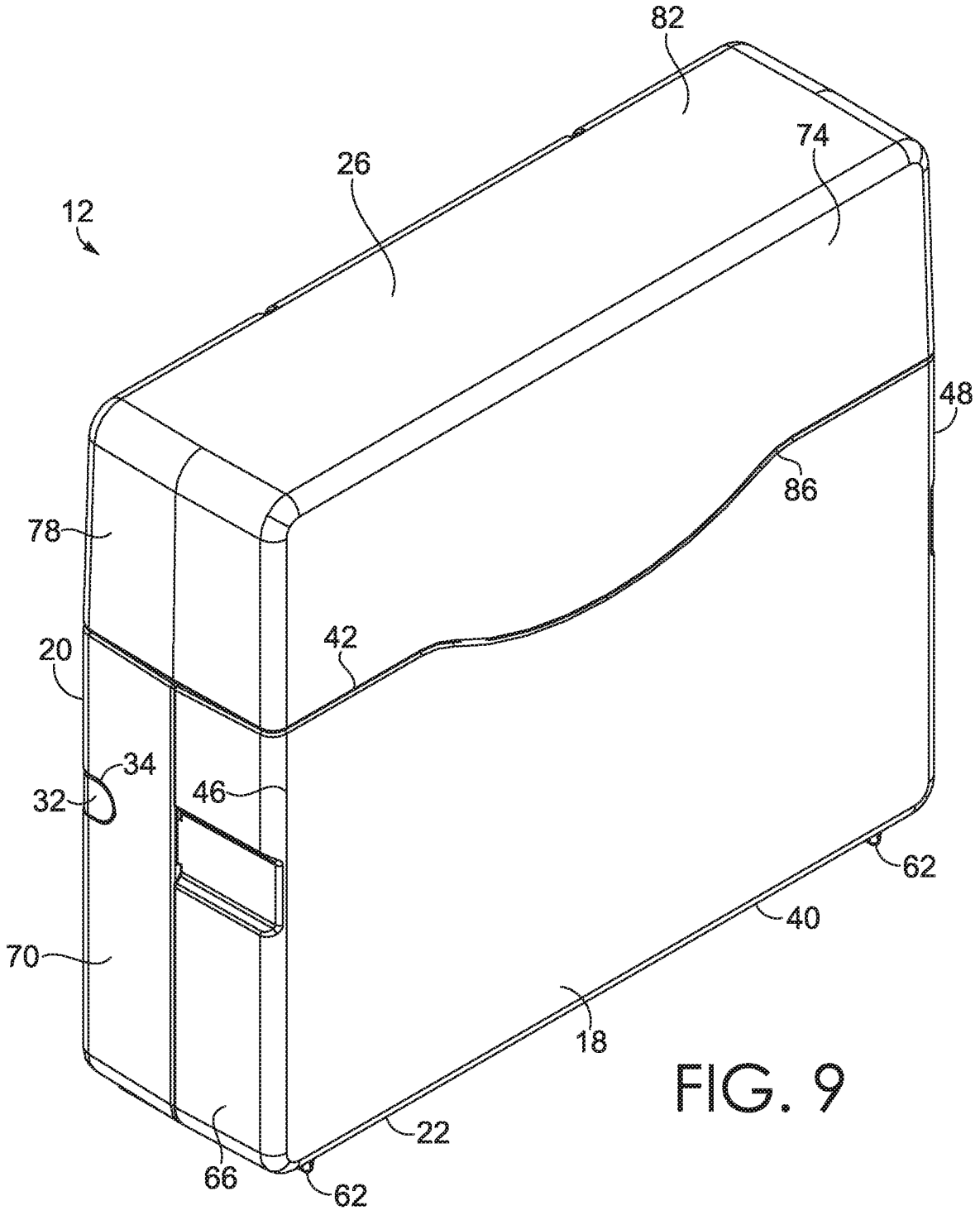
FIG. 9 is a front, perspective view of the molded container of FIG. 1 in the closed position and in the retaining configuration.
Figure 15:
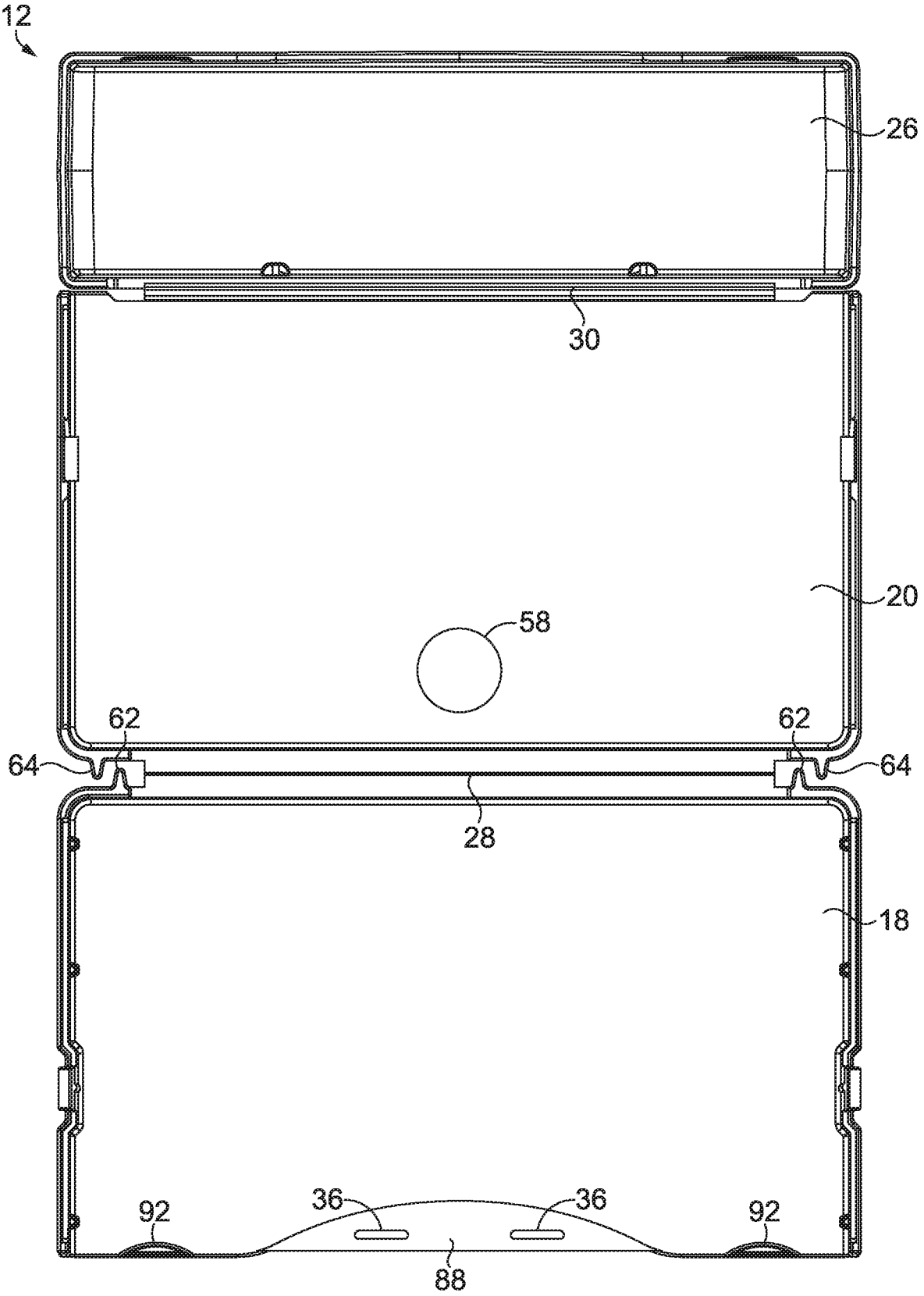
FIG. 15 is an internal-surface, expanded view of the molded container in a loading configuration or as-molded configuration, according to some aspects of the invention.
Figure 17:
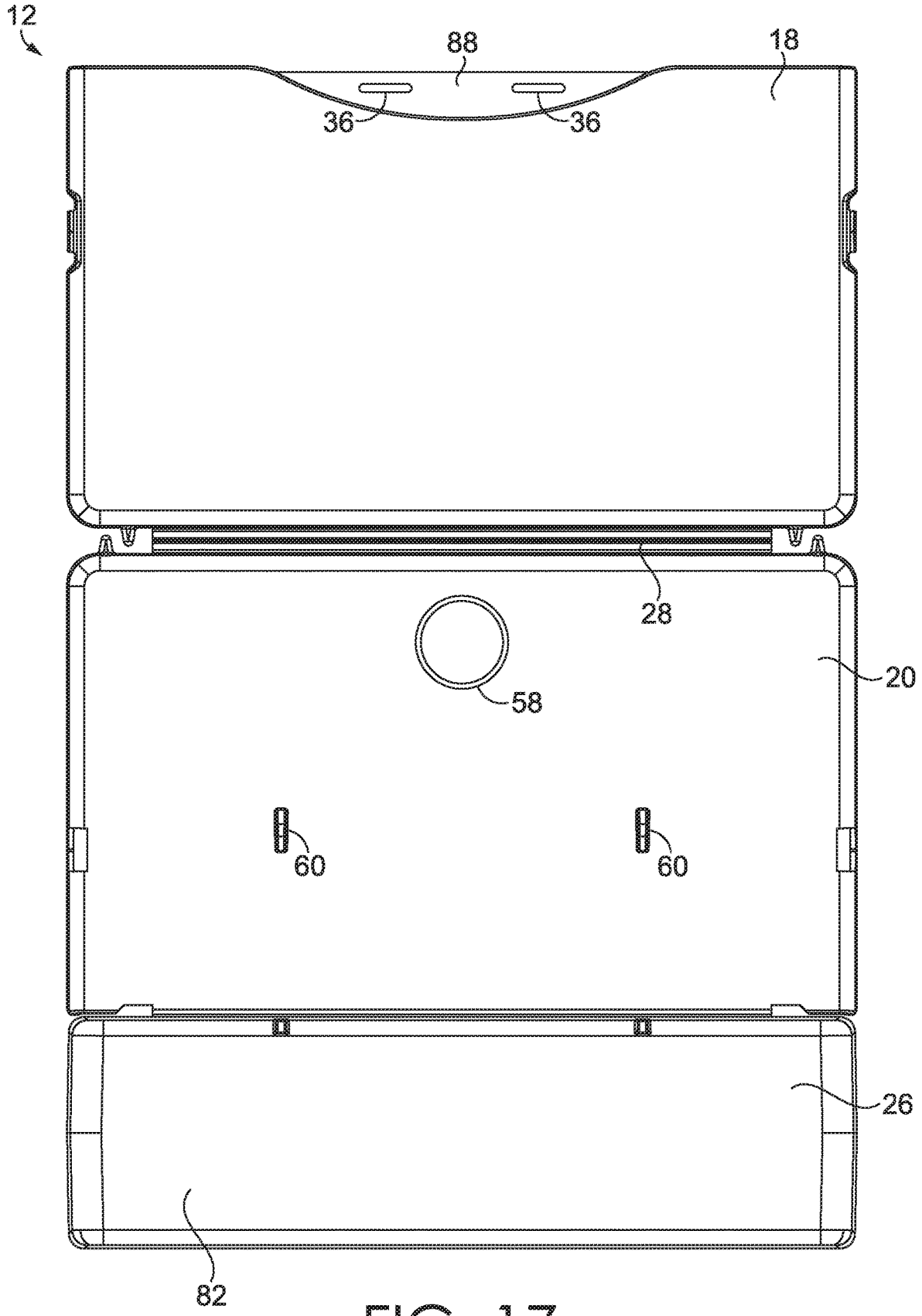
FIG. 17 is an external-surface, expanded view of the molded container of FIG. 15 in the loading configuration or as-molded configuration.
Figure 18:
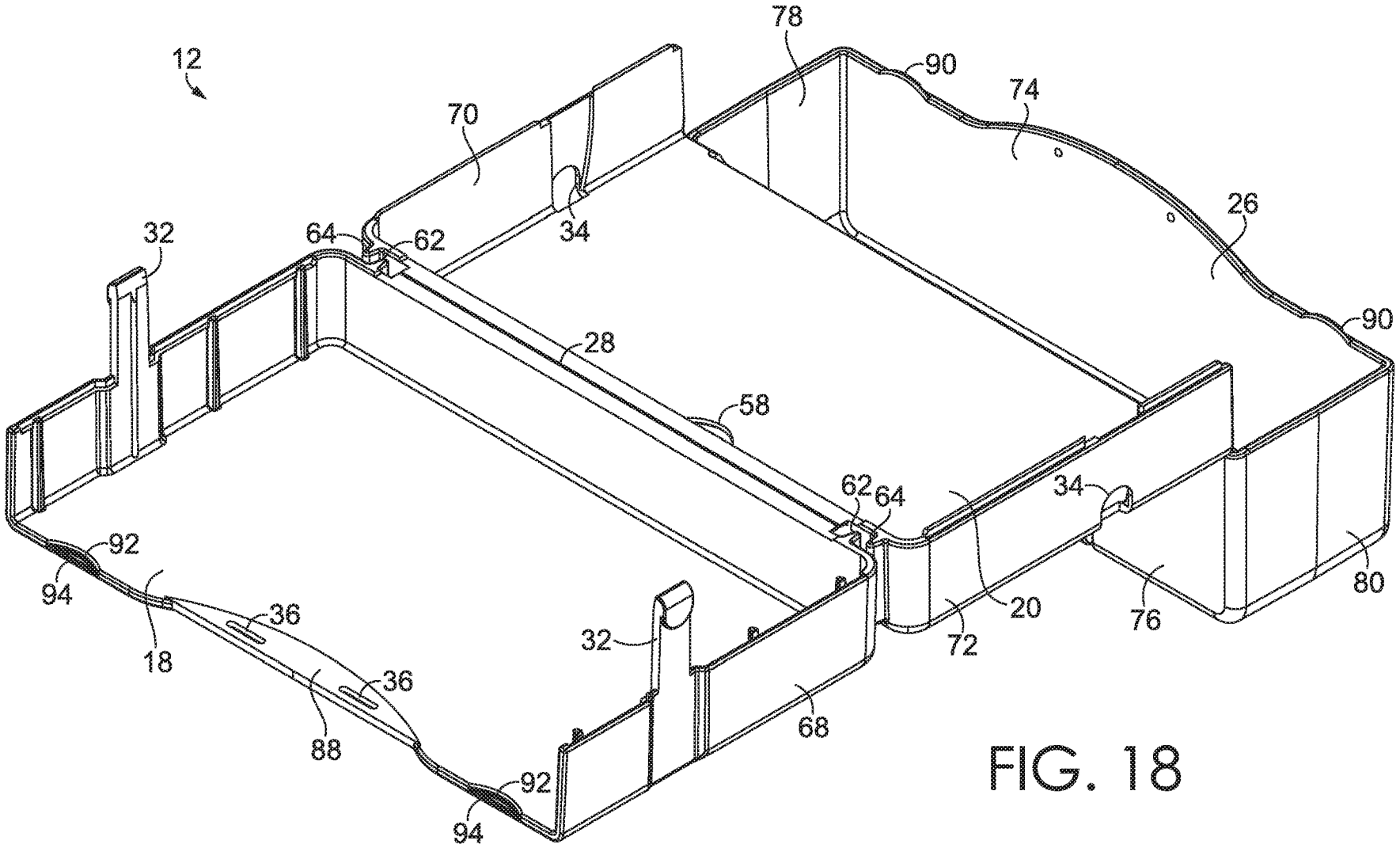
FIG. 18 is a perspective internal-surface, expanded view of the molded container in the loading configuration or as-molded configuration, according to some aspects of the invention.
Figure 19:
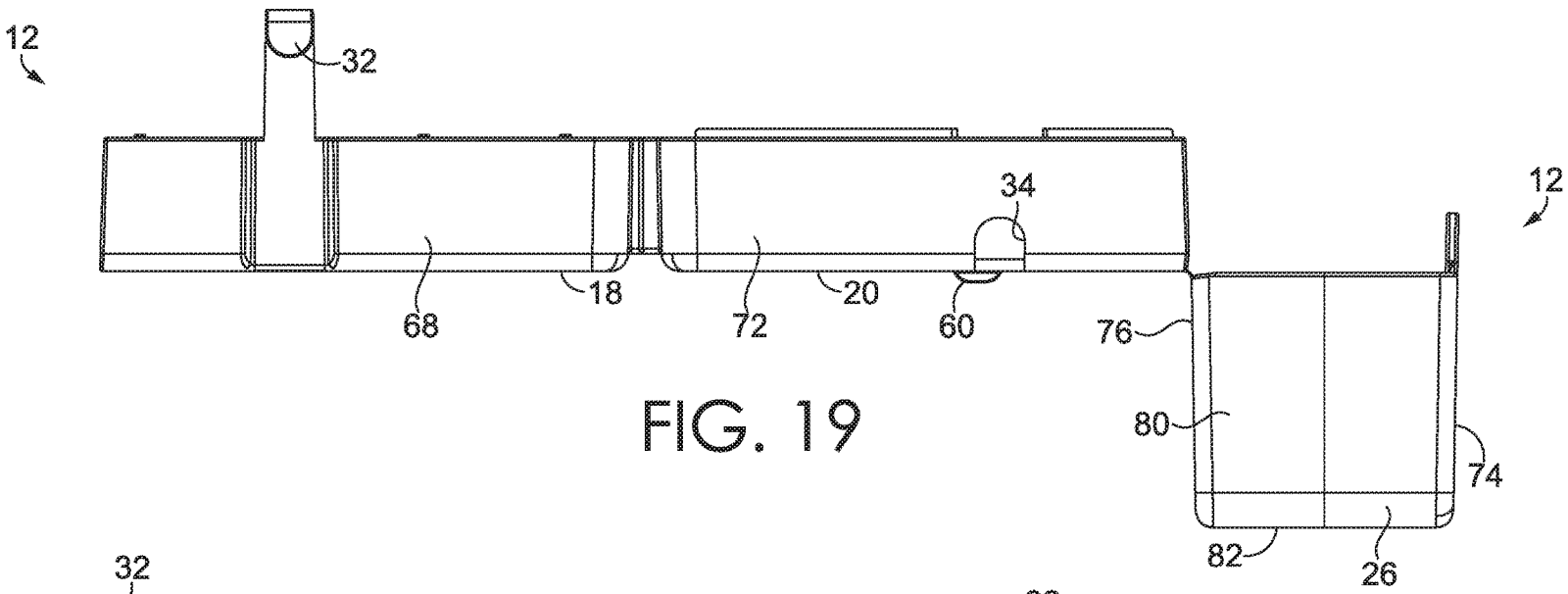
FIG. 19 is a side view of the molded container of FIG. 18 in the loading or as-molded configuration.
Figure 20:
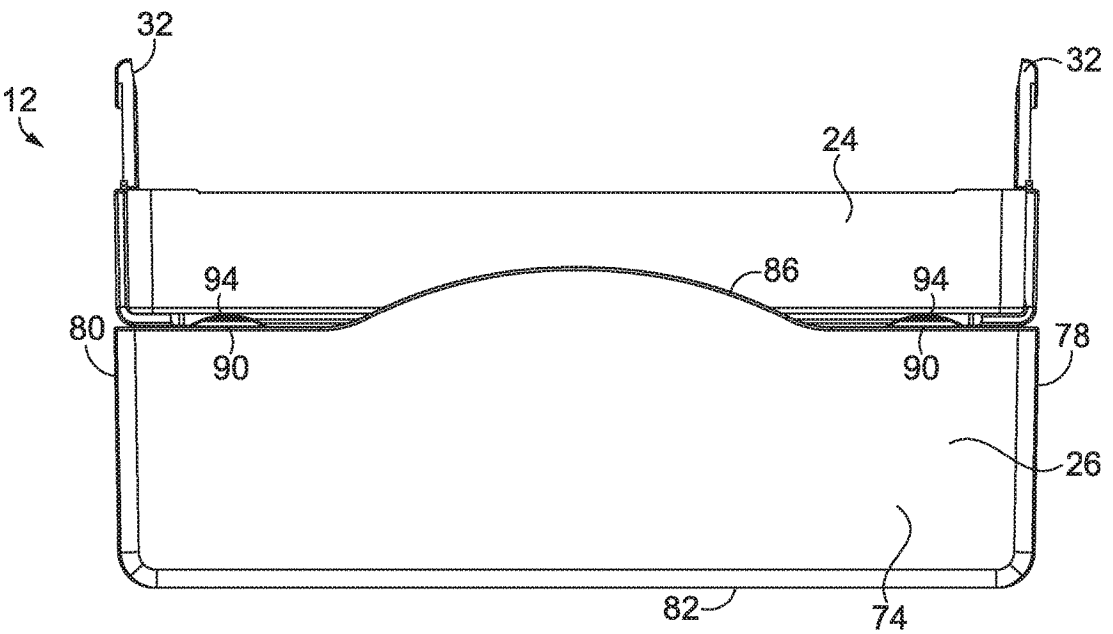
FIG. 20 is a top view of the molded container of FIG. 18 in the loading or as-molded configuration.
Figure 22:
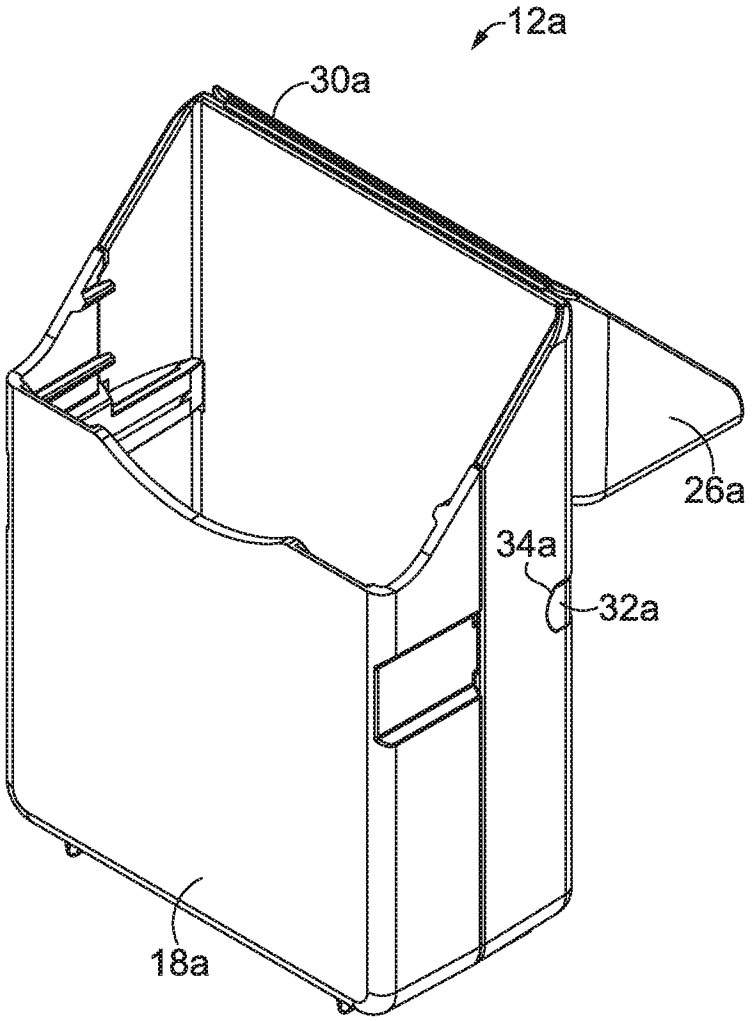
FIG. 22 is a perspective view of the molded container of FIG. 21 in an open position.
Figure 21:
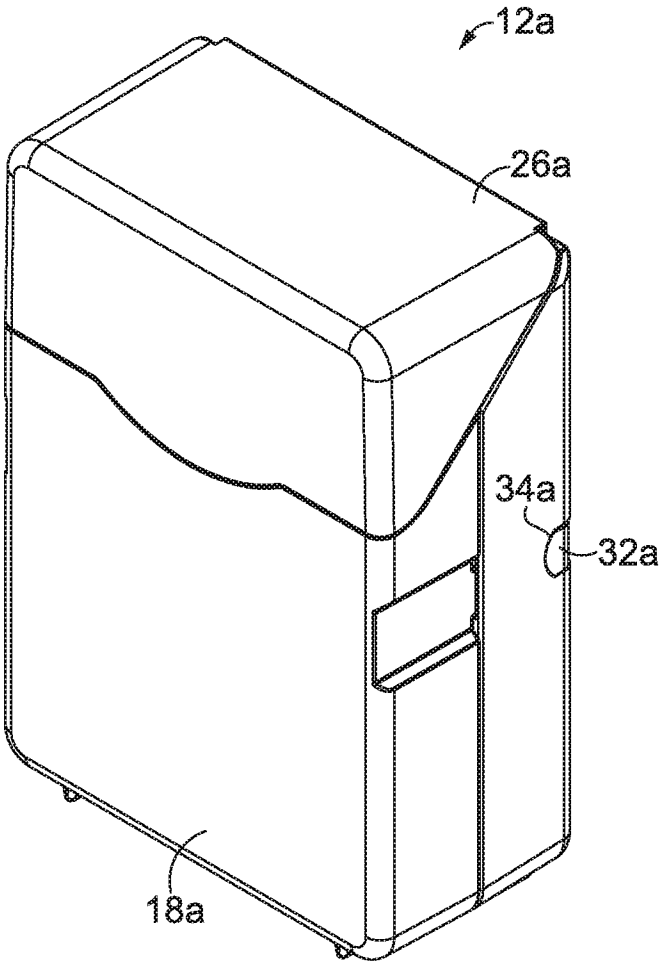
FIG. 21 is a perspective view of an alternative embodiment of the molded container configured in an assembled and closed position, according to some aspects of the invention.
Figure 23:
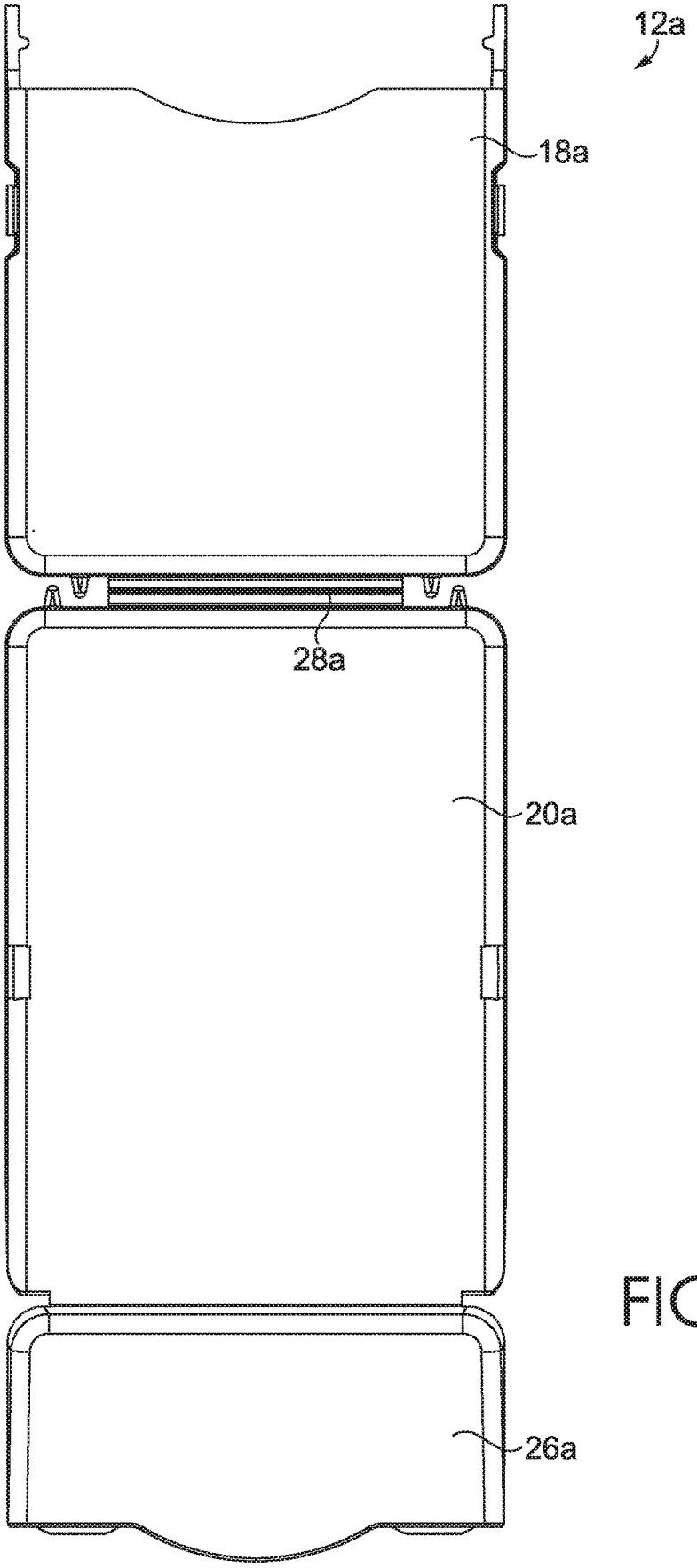
FIG. 23 is an external-surface, expanded view of the molded container of FIG. 21.
Figure 24:
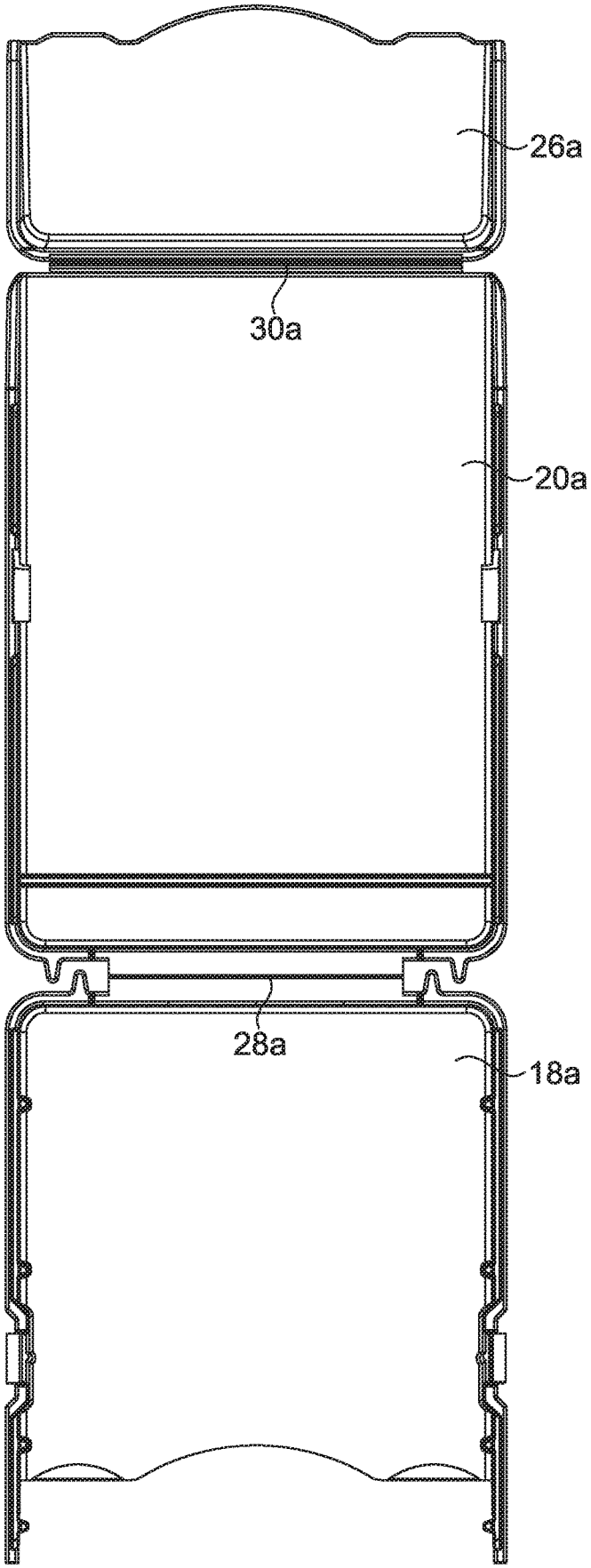
FIG. 24 is an internal-surface, expanded view of the molded container of FIG. 21.
Figure 25:
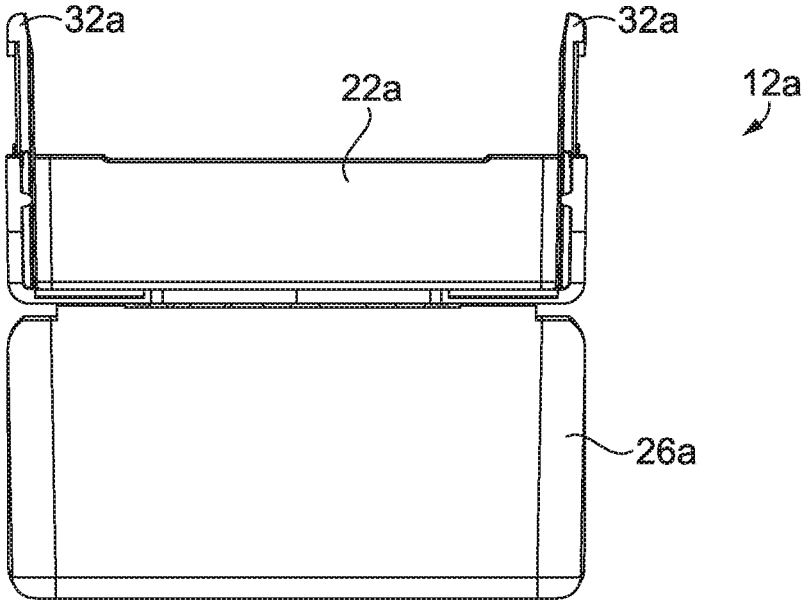
FIG. 25 is a top view of the molded container of FIG. 21 in the open position.
Figure 26:
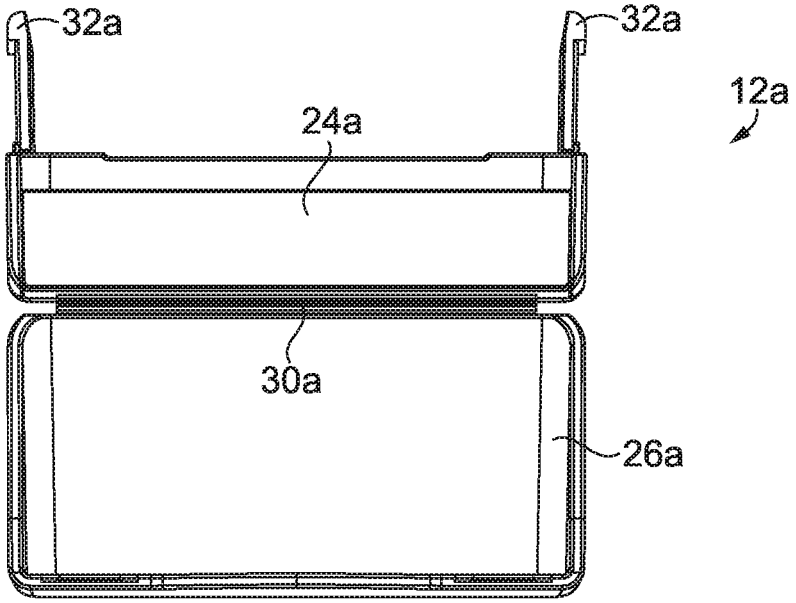
FIG. 26 is a bottom view of the molded container of FIG. 21 in the open position.
Figure 27:
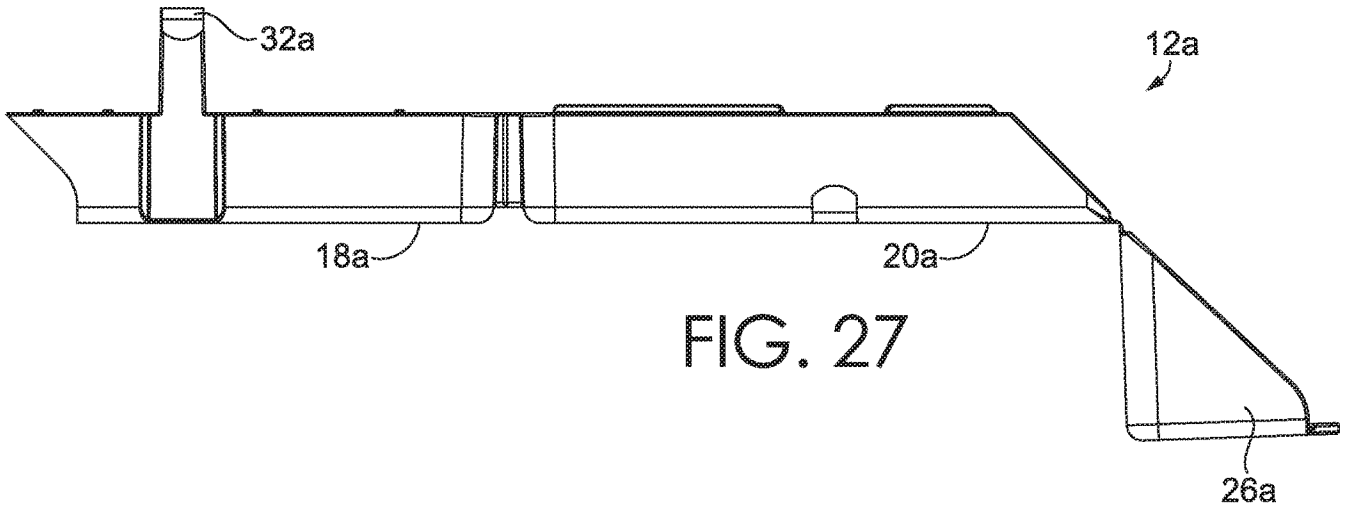
FIG. 27 is a side view of the molded container of FIG. 21 in a loading configuration or an as-molded configuration.
Figure 28:
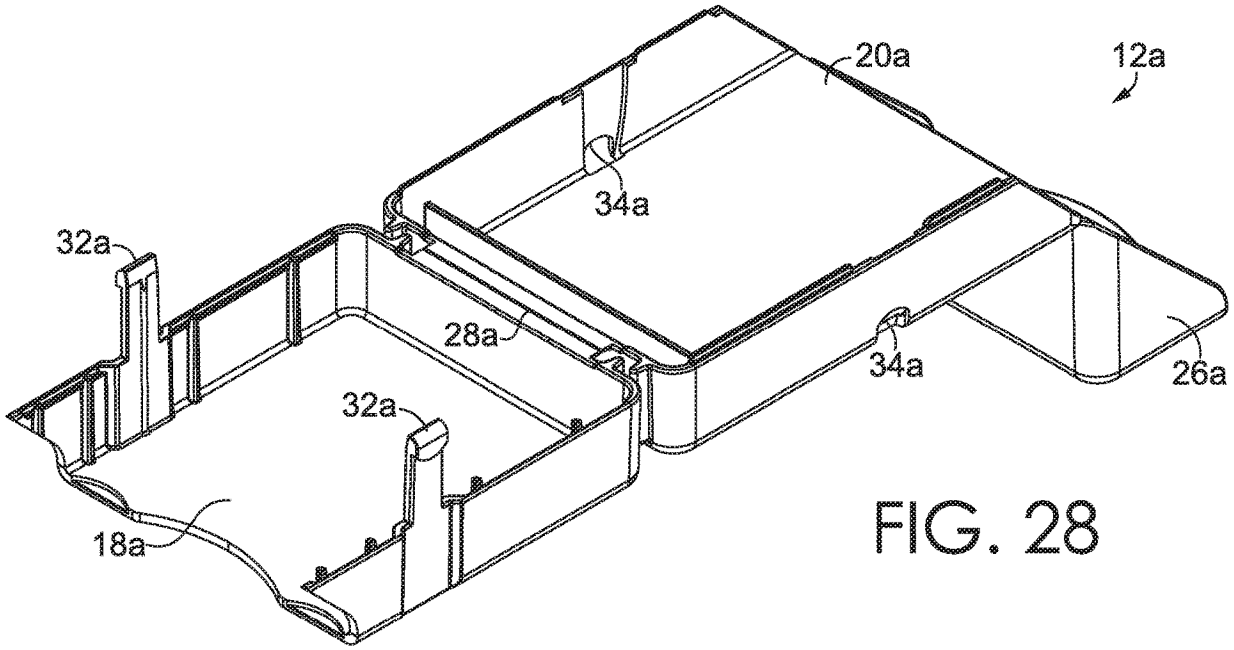
FIG. 28 is a perspective view of the molded container of FIG. 21 in the loading configuration or the as-molded configuration.
Figure 29:
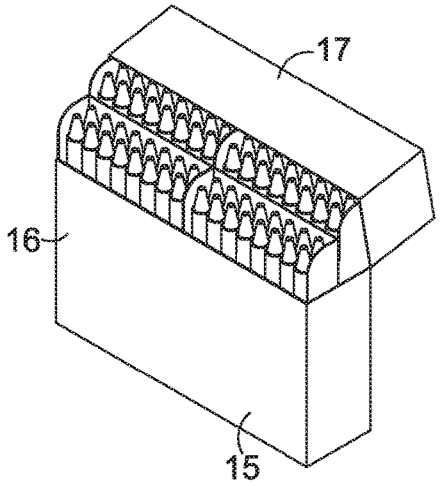
FIG. 29 is a perspective view of an exemplary writing utensil disposable container with sixty-four crayons therein.

The front bottom component 22 and the back bottom component 24, as illustrated in FIG. 6, may be thin, substantially-rigid plastic panels pivotally coupled together via one of the hinges 28, 30, as later described herein. The front and/or back bottom components 22, 24 may additionally comprise two or more elevating protrusions 62, 64 extending outward therefrom for supporting the molded container 12 in an upright orientation when standing in a retaining configuration, as later described herein and illustrated in FIGS. 3-4 and 9-13. In particular, the elevating protrusions 62, 64 may extend away from an outer surface of the front and/or back bottom components 22, 24 by an amount greater than half a width of the bottom integral hinge component 28, such that the bottom integral hinge component 28 does not interfere with upright standing of the molded container. The elevating protrusions 62, 64 can include a front set of elevating protrusions 62 extending from the front bottom component 22 and a back set of elevating protrusions 64 extending from the back bottom component 24. In some embodiments, the front and back sets of elevating protrusions 62, 64 are offset in a vertical orientation such that when in an as-molded orientation or loading configuration, the front set and back set of elevating protrusions 62, 64 do not collide with each other, as illustrated in FIGS. 15, 17, and 18.

In some embodiments, as illustrated in FIGS. 5-11, the molded container 12 may also have two opposing front side panels 66, 68 that extend at angles from the side edges 46, 48 of the container front panel 18 and two opposing back side panels 70, 72 that extend at angles from the side edges 54, 56 of the container back panel 20. For example, the angles of these side panels 66-72 may extend at an angle of substantially 90-degrees relative to the container front and back panels 18, 20. The front and back side panels 66-72 may have interior edges such that the front side panel's interior edges abut or rest against the back side panel's interior edges when the molded container 12 is in the retaining configuration, as later described herein. The front and back side panels 66-72 may also cooperatively form opposing top side edges when the molded container 12 is in the retaining configuration. These top side edges may, in some embodiments, form non-right angled top edges when mating in the retaining configuration, as illustrated in the alternative embodiment depicted in FIG. 21-28. At least some of the front and back side panels 66-72 may include the front coupling mechanism 32 or the back coupling mechanism 34 as later described herein and illustrated in FIGS. 7-8 and 18-19.

As depicted in FIGS. 7-13 and 18-20, the container lid component 26 may comprise a lid front panel 74, a lid back panel 76, two opposing lid side panels 78, 80 extending between the lid front and back panels 74, 76, and a lid top panel 82. However, the container lid component 26 may have other shapes or configurations for covering a top opening formed between the container front and back panels 18, 20 without departing from the scope of the invention. The container lid component 26 may be pivotally coupled to the container back panel 20 via one of the hinges 28, 30 as described below.

Figure 16:
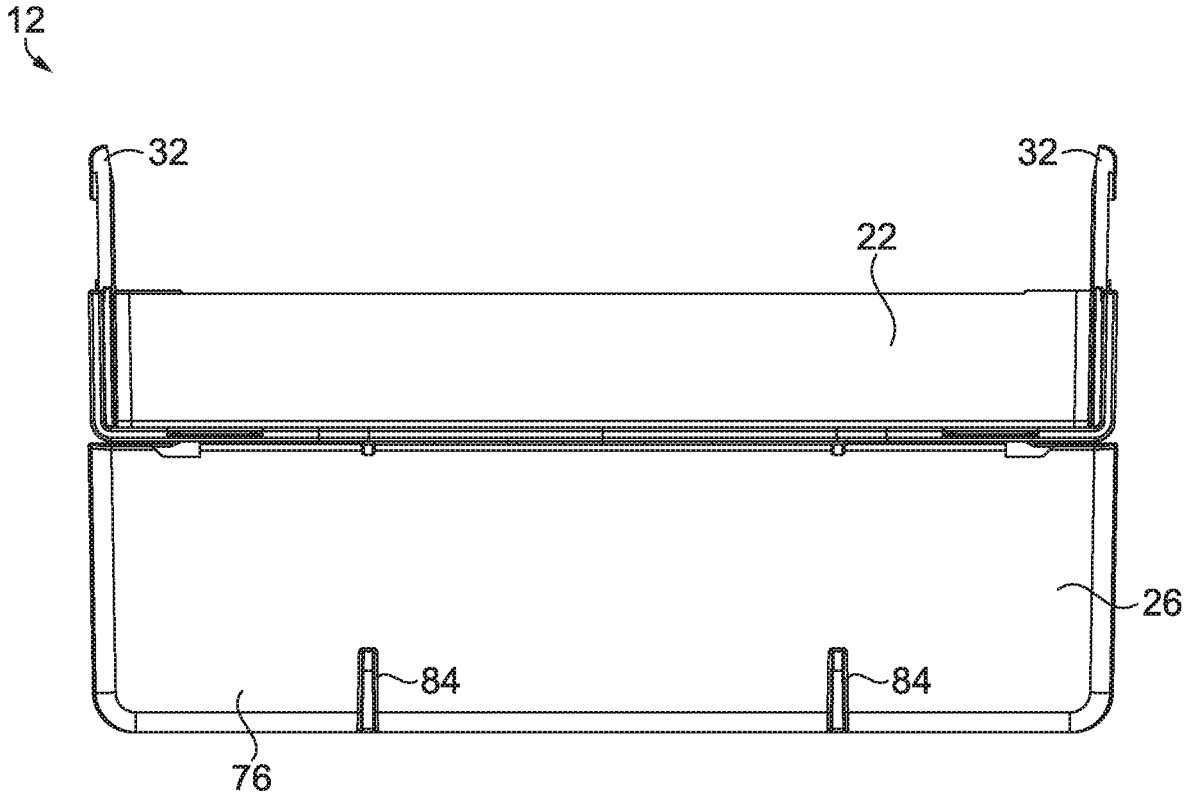
FIG. 16 is a top view of the molded container of FIG. 15 in the expanded loading configuration or as-molded configuration.

Furthermore, the container lid component 26 may have hold-open features 84 for mating with the hold-open features 60 of the container back panel 20, as depicted in FIGS. 4 and 16. For example, the hold-open features 84 may be indentions formed into the container lid component 26 or apertures formed therethrough for receiving and/or retaining protrusions of the container back panel 20, thereby holding the container lid component 26 in the open position with the lid back panel 76 against an outer surface of the container back panel 20. Conversely, the hold-open features 84 may be protrusions extending from the container lid component 26 and configured for insertion into indentions or holes of the container back panel 20 in the open position.

Figure 10:
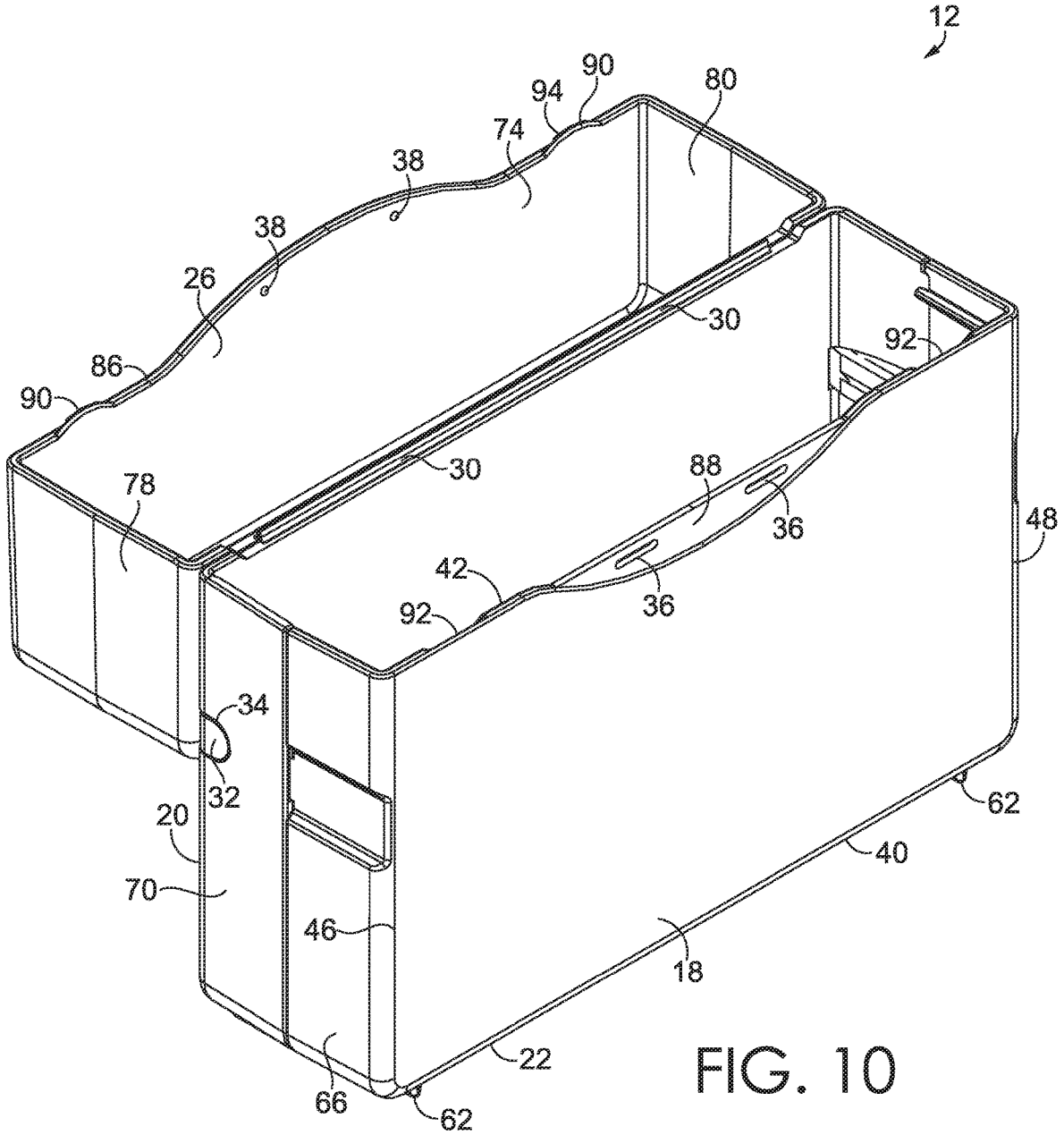
FIG. 10 a front, perspective view of the molded container of FIG. 1 in an open position and in the retaining configuration.
Figure 11:
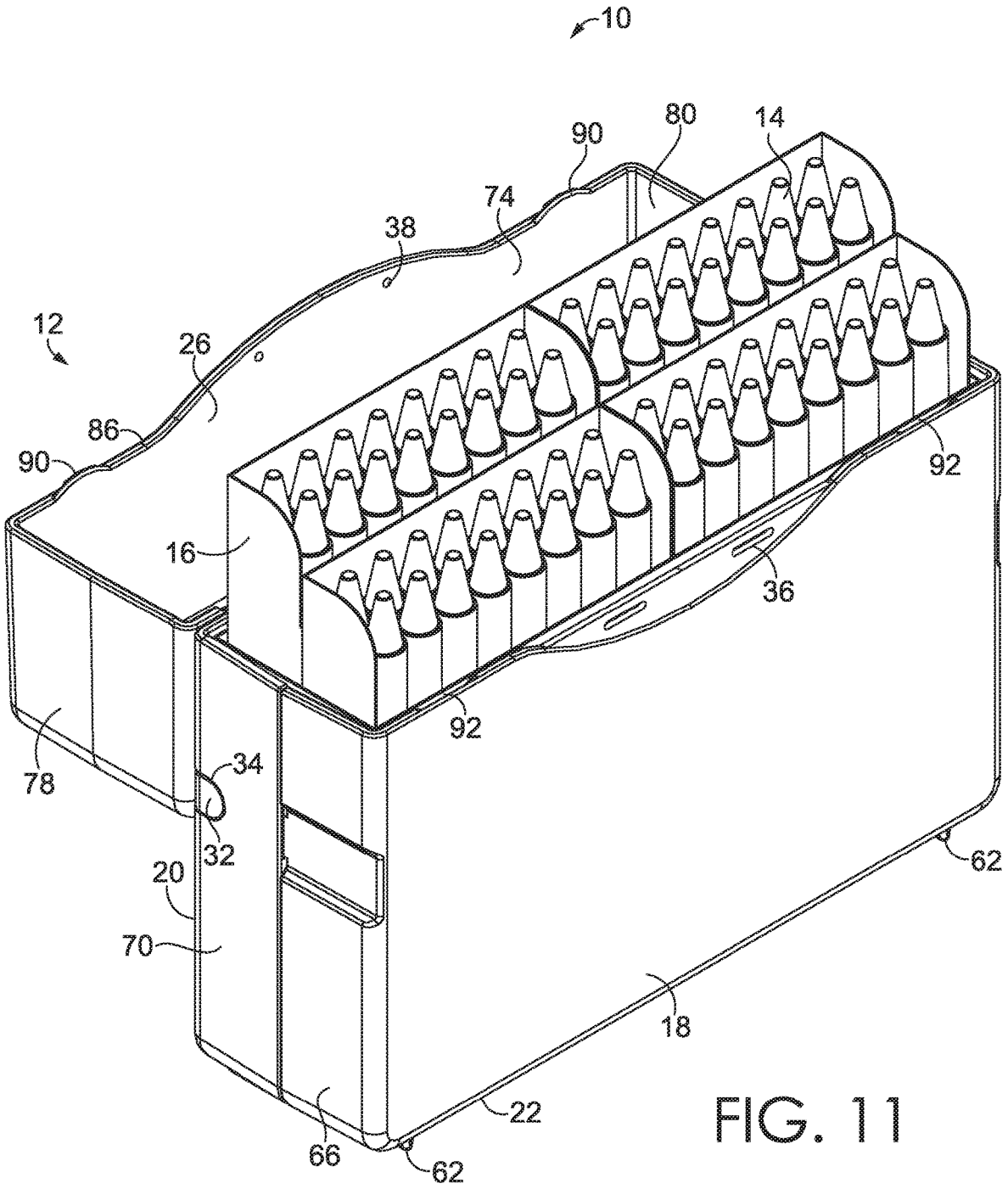
FIG. 11 a front, perspective view of the molded container of FIG. 1 in the open position and enclosing a plurality of writing utensils, according to some aspects of the invention.
Figure 12:
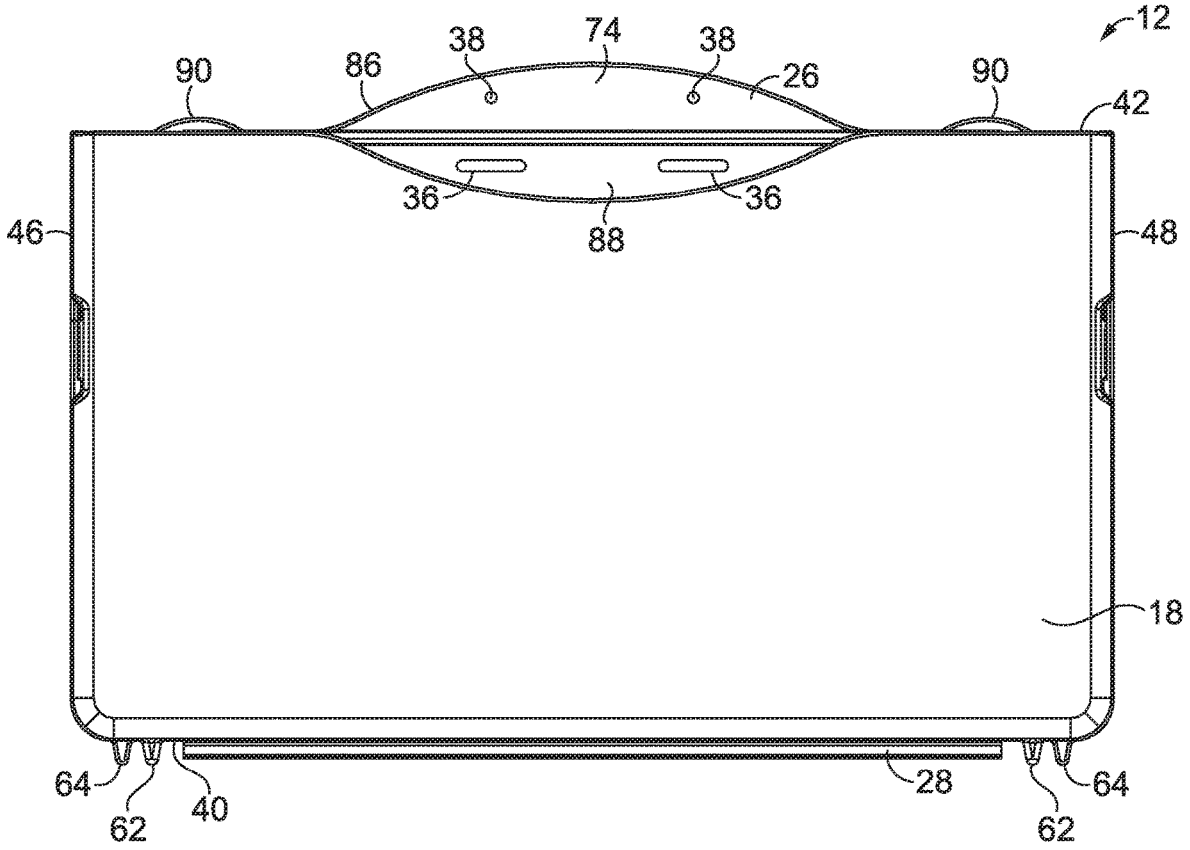
FIG. 12 is a front view of the molded container of FIG. 1 in the open position.
Figure 13:
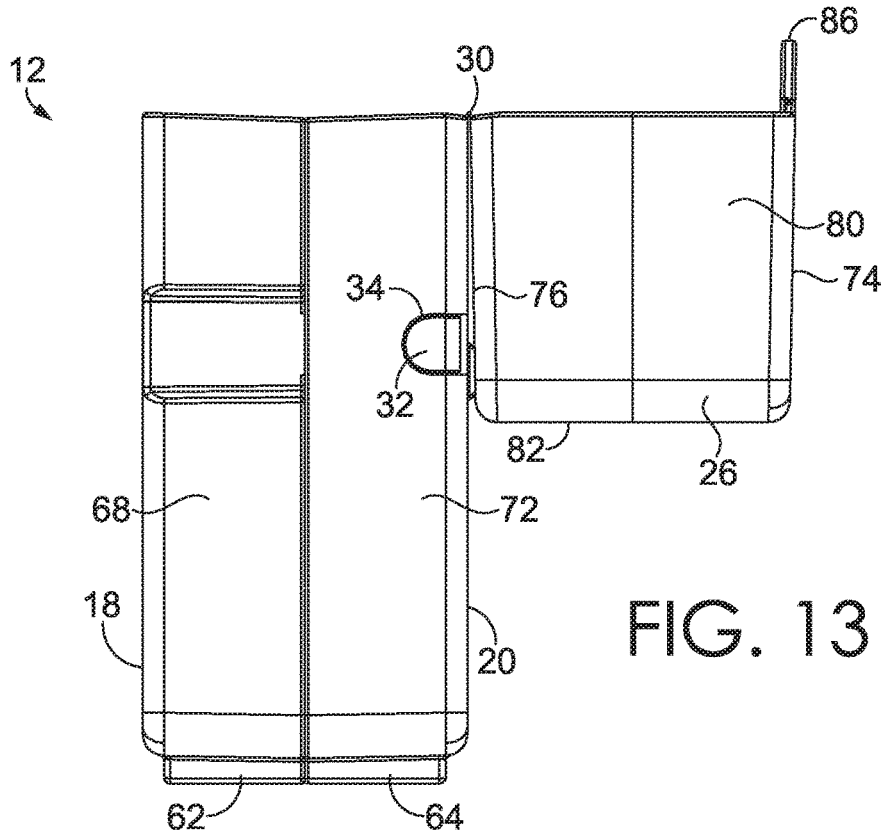
FIG. 13 is a side view of the molded container of FIG. 1 in the open position.
Figure 14:
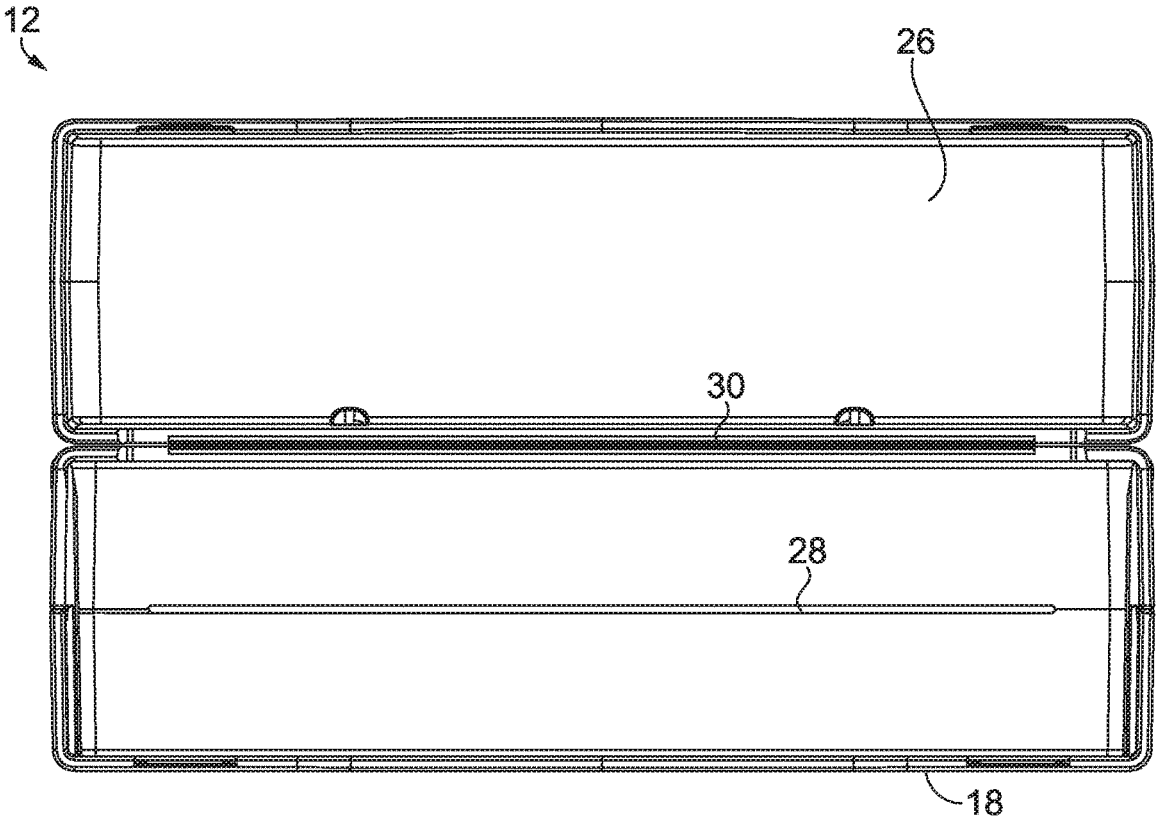
FIG. 14 is a top view of the molded container of FIG. 1 in the open position.

In some embodiments, the lid front panel 74 of the container lid component 26 may have a mating edge 86 at which the lid front panel 74 engages with the container front panel 18, as depicted in FIGS. 10-12. Specifically, the mating edge 86 may be shaped such that at least one portion of the lid front panel 74 extends further or hangs lower than the rest of the container lid component 26, thereby overlapping a portion 88 of the container front panel 18. This overlapped portion 88 of the container front panel 18 may be thinner than the rest of the container front panel 18 or may be recessed into a front surface of the container front panel 18 for ease of overlap. Likewise, the container lid component 26 may have one or more tabs 90 or protrusions extending downward beyond the mating edge 86 and configured to overlap with tab receiving portions 92 recessed into an inner surface of the container front panel. In some embodiments, the tabs 90 and the tab receiving portions 92 may include flanges 94 or ledges extending outward or inward therefrom and configured to couple or engage the tabs 90 and the tab receiving portions 92 when the container lid component 26 is in a closed position.

The lid closure feature 38 may be formed on the lid front panel 74 and may include one or more indentions, holes, or protrusions. Likewise, as noted above, the front closure feature 36 may be formed on the container front panel 20 and may include one or more indentions, holes, or protrusions configured for coupling, engaging, or interlocking with the lid closure feature 38. For example, as illustrated in FIGS. 10-12, the lid closure feature 38 may include a set of protrusions which engage with a set of holes formed through the container front panel 20 and serving as the front closure features 36. However, in some embodiments, the holes could be indentions or could be replaced with protrusions to engage with protrusions, indentions, or holes on the lid front panel 74. Furthermore, in some embodiments, the flanges 94, ledges, tabs 90, or tab receiving portions 92 described above may also be considered front closure features 36 or lid closure features 38 without departing from the scope of the invention.

The hinges 28, 30, as depicted in FIGS. 15, 17, and 18, may be any hinge known in the art for allowing pivoting between two components. In some aspects of the invention, these hinges 28, 30 may be integral hinge components or "living hinges," which form an articulating structure that is injection molded and can transform into a container having molded surfaces oriented in different planes. Specifically, the hinges 28, 30 may be living hinges formed from a segment of molded container 12 having a particular density along the axis of the segment, such as a foldable segment of molded material between two components of the molded container 12. This foldable segment of molded material may be formed by molding a narrow strip of the molded container's plastic to be thinner than portions on either side of the narrow strip and then bending or otherwise creasing the narrow strip after molding is complete and the plastic has cooled and hardened. This folding or creasing may be down a middle line of the narrow strip or offset from a middle line thereof.

The bottom integral hinge component 28 may be integrally formed with and extend between the front bottom component 22 and the back bottom component 24 for pivoting the container front panel 18 and/or the container back panel 20 toward and away from each other. Likewise, the lid integral hinge component 30 may be integrally formed with and extend between the container back panel 20 and the lid back panel 76 of the container lid component 26.

In the as-molded orientation or loading configuration, as illustrated in FIGS. 15 and 17, the container front panel 18 and the container back panel 20 can be formed in a single plane, side-by-side with each other, with the front bottom component 22 and the back bottom component 24 extending upward therefrom at right angles and parallel to each other, and the bottom integral hinge component 28 may extend between edges of the front and back bottom components 22, 24 at a right angle relative to the front and back bottom components 24. The lid integral hinge component 30 may extend between the lid back panel 76 and the container back panel 20 resting in approximately the same plane in the as-molded orientation or loading configuration. However, other as-molded configurations may be used without departing from the scope of the invention.

The front and back coupling mechanisms 32, 34 may be configured to selectively couple, engage, or interlock with each other when the molded container 12 is in the retaining configuration, as depicted in FIGS. 1-13, in which the container front and back panels 18, 20 are substantially parallel with each other (as opposed to in their planar as-molded orientation described above) The front and back coupling mechanisms 32,34 may include protrusions, indentions, and/or openings. In some embodiments, the front and back coupling mechanisms 32, 34 may be one-time snap locks or other mechanical snap joints known in the art.

In some embodiments, front coupling mechanisms 32 may be integral with or formed into or through the front side panels 66, 68 while the back coupling mechanisms 34 are integral with or formed into or through the back side panels 70, 72. For example, the front coupling mechanisms 32 can protrude from the front side panels 66, 68 and the back coupling mechanisms 34 can be indentions or apertures formed into or through the back side panels 70, 72. Furthermore, the front coupling mechanisms 32 may include a cantilever with a protruded tab at one end, such that the cantilever can flex to be ejected from the holes of the back coupling mechanisms 34 to release from the retaining configuration to the as-molded configuration.

Additional features of the molded container can include, for example, a crayon wrapper removal tool (not shown), such as the ones described in U.S. Published Patent Application No. 2018/0272443, incorporated by reference in its entirety herein. The crayon wrapper removal tool may be integrally molded to one of the front or back side panels, one of the container front or back panels, or the container lid component. For example, a holder for the crayon wrapper removal tool may be integrally molded on an outer surface or inner surface of the container for storing the crayon wrapper release mechanism with the crayons. In another example embodiment, the crayon wrapper removal tool itself may have one end integrally molded with and affixed to the container for removing crayon wrapper paper off of crayons or other writing utensils therewith.

A method for making the molded container 12 may include injection molding a unitary plastic structure having at least two living hinges 28, 30 (integral hinge components) formed by foldable segments of molded material molded therein and at least two coupling mechanisms 32, 34 formed into or extending from the unitary plastic structure, as described and depicted herein.

In use, a writing utensil box or other such disposable container 16 may be placed against the container back panel 20 or the container front panel 18 and the back bottom component 24 or the front bottom component 22. Then, the molded container 12 may be oriented from a loading configuration (e.g., the as-molded configuration of FIGS. 15 and 17) into a retaining configuration, as illustrated in FIGS. 1-13, by pivoting at the bottom integral hinge component 28 to form an internal cavity and joined via the front and back coupling mechanisms 32, 34. This may sandwich the disposable container 16 between the container front panel 18 and the container back panel 20. Dimensions of the internal cavity, in embodiments, correspond to dimensions of the desired container of writing utensils to be enclosed.

Figure 1:
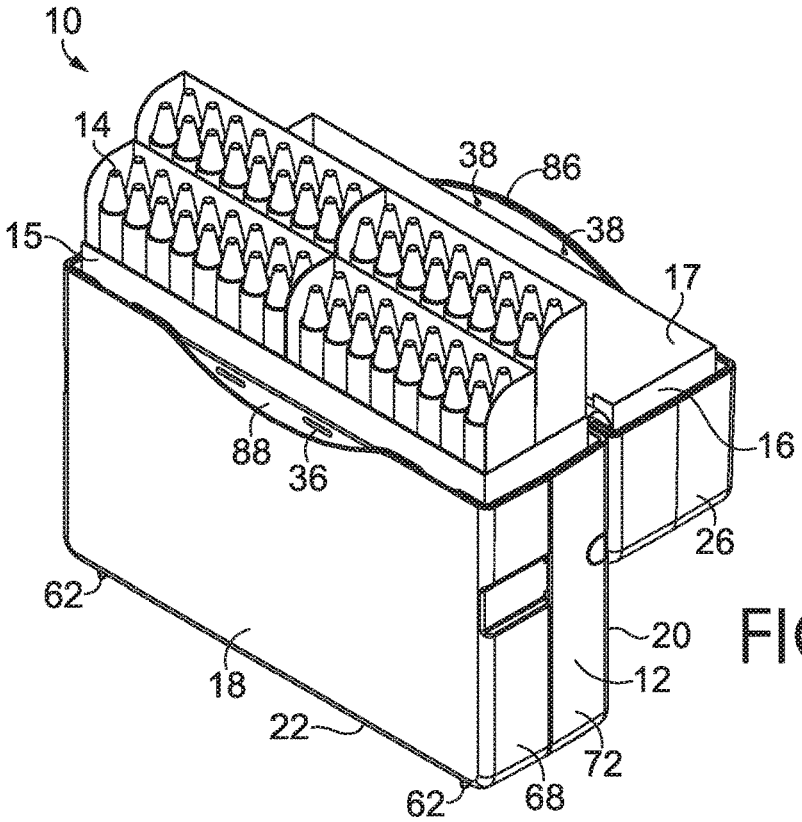
FIG. 1 is a top perspective view of an exemplary writing utensil container kit, constructed in accordance with embodiments of the present invention and including an integrally molded container for holding a writing utensil disposable box.
Figure 2:
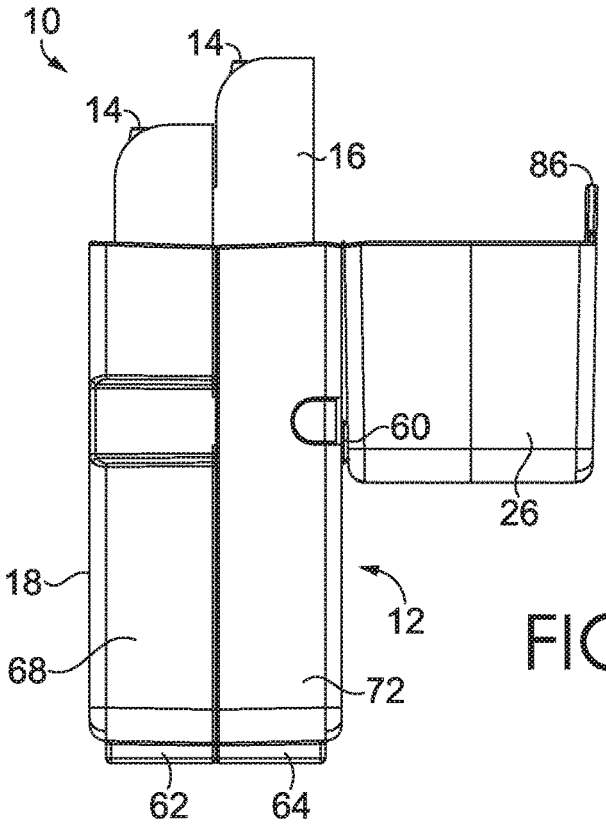
FIG. 2 is a side view of the writing utensil container kit of FIG. 1.

Then, the container lid component 26 may be pivoted about the lid integral hinge component 30 from an open position, as in FIGS. 1-2, to a closed position, as in FIGS. 3-4, and detachably secured to the container front panel 18, covering the internal cavity and the writing utensils 14 therein. Additionally, the disposable container's lid 17, in some configurations, may be retained within the container lid component 26, such that the lid 17 moves and pivots cooperatively with the container lid component 26.

To remove writing utensils 14 from the molded container 12, the container lid component 26 may be pivoted into the open position, uncovering the internal cavity. Furthermore, the hold-open features 60, 84 described above may couple with each other when the container lid component 26 is in the open position for detachably securing the container lid component 26 in the open position.

To remove the disposable container 16 of writing utensils 14, at least one of the front or back coupling mechanisms 32, 34 may be pressed inward toward the internal cavity until the front and back coupling mechanisms 32, 34 uncouple from each other. However, other methods of uncoupling the front and back coupling mechanisms 32, 34 may be used without departing from the scope of the invention.

Next, at least one of the container front panel 18 and the container back panel 20 may be pivoted away from each other, allowing the disposable container 16 of writing utensils 14 to be removed therefrom. Although embodiments of the invention are described herein as holding or containing crayon boxes and/or crayon sleeves, the molded container may be shaped and sized for other boxes or packages of writing utensils such as markers, colored pencils, chalk, pens, and the like without departing from the scope of the invention.

Many different arrangements of the various components depicted, as well as components not shown, are possible without departing from the scope of the claims below. For example, the molded container 12*a* of FIGS. 21-28 depicted a container front panel 18*a*, a container back panel 20*a*, a front bottom component 22*a*, a back bottom component 24*a*, a container lid component 26*a*, hinges 28*a*, 30*a*, and front and back coupling mechanisms 32*a*, 34*a* which are substantially identical to the corresponding numerals 12 and 18-34 described above, except that the molded container 12*a* is configured for thirty-two writing utensils instead of sixty-four.

Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A writing utensil container formed from a single plastic mold comprising:

a container front panel and front bottom component, wherein the container front panel comprises at least one front coupling mechanism and at least one front closure feature;

two opposing front side panels integral with the container front panel and the front bottom component, wherein the front coupling mechanism is associated with at least one of the front side panels based on at least one of protruding from, having an indentation formed with, and having an aperture formed into at least one of the front side panels;

a container back panel and back bottom component, said front bottom component hingedly coupled directly to the back bottom component, wherein the container back panel comprises at least one back coupling mechanism located to selectively engage with the at least one front coupling mechanism;

two opposing back side panels integral with the container back panel and the back bottom component, wherein the back coupling mechanism is one or more of an indention and an aperture formed into, protruding into, or protruding from at least one of the back side panels; and a container lid component hingedly coupled to the container back panel, wherein the container lid component comprises at least one lid closure feature, said at least one lid closure feature configured to removably couple to the at least one front closure feature.

2. The writing utensil container of claim 1, further comprising an integral hinge component formed by a foldable segment of molded material extending between the front bottom component and the back bottom component, such that the container front panel and the front bottom component are pivotal away from the container back panel and back bottom component into a loading configuration for loading at least one writing utensil box or sleeve therein and are pivotal toward the container back panel and back bottom component into a retaining configuration for retaining the at least one writing utensil box or sleeve loaded therein between the container front panel and the container back panel.

3. The writing utensil container of claim 2, wherein, in the retaining configuration, the front coupling mechanism and the back coupling mechanism align and engage with each other preventing pivoting of the container front panel with respect to the container back panel about the integral hinge component, wherein when the front coupling mechanism and the back coupling mechanism are selectively disengaged from being interlocked with each other, at least one of the container front panel and the container back panel is operable to pivot away from each other from the retaining configuration to the loading configuration.

4. The writing utensil container of claim 1, further comprising an integral hinge component hingedly coupling the container lid component to the container back panel, wherein the integral hinge component is formed by a foldable segment of molded material extending between the container back panel and the container lid, such that the container lid is pivotal about the integral hinge component toward the container front panel into a closed position and is pivotal away from the container front panel into an open position.

5. The writing utensil container of claim 4, wherein, in the closed position, the front closure feature engages with the lid closure feature, retaining the container lid in the closed configuration until the front closure feature is disengaged from the lid closure feature.

6. The writing utensil container of claim 5, wherein at least one of the front closure feature and the lid closure feature is a protrusion and wherein at least one of the front closure feature and the lid closure feature is at least one of an indentation or an aperture formed in at least one of the container lid component and the container front panel.

7. The writing utensil container of claim 1, wherein at least one of the container back panel and the container front panel has an access aperture formed there through for external access therethrough to a sharpener integral with at least one of a writing utensil box and a writing utensil sleeve to be loaded into the writing utensil container.

8. The writing utensil container of claim 1, further comprising at least one of an indentation and a protrusion formed into or extending outward from the container back panel and at least one of a protrusion and an indention associated with the container lid and aligned such that the at least one of the indention and the protrusion of the container back panel is selectively engagable with the at least one of the protrusion and the indention of the container lid and when the lid is in an open position.

9. The writing utensil container of claim 1, wherein the opposing front side panels and the opposing back side panels cooperatively form an angled top edge when mating in a retaining configuration for retaining at least one writing utensil box or sleeve loaded therein between the container front panel and the container back panel.

10. The writing utensil container device of claim 1, further comprising a crayon wrapper removal tool protruding from the container front panel, the container back panel, or the container lid.

11. The writing utensil container of claim 1, further comprising at least one of a crayon wrapper removal tool holder and a crayon wrapper removal tool protruding from at least one of one or more of the front side panels or one or more of the back side panels.

12. The writing utensil container of claim 1, further comprising at least two elevating protrusion extending outward from at least one of the front bottom component and the back bottom component for supporting the writing utensil container in an upright orientation when the at least one front coupling mechanism is engaged with the at least one back coupling mechanism.

13. The writing utensil container of claim 12, wherein the elevating protrusions include a front set of elevating protrusions extending from the front bottom component and back set of elevating protrusions extending from the back bottom component, wherein the front and back sets of elevating protrusions are offset from each other such that when in the loading configuration, the front set and back set of elevating protrusions are offset from one another in a vertical orientation.

14. A writing utensil container kit comprising:

a plastic container formed from a single plastic mold comprising:

a container front panel and front bottom component, wherein the container front panel comprises at least one front coupling mechanism and at least one front closure feature, a container back panel and back bottom component, said front bottom component hingedly coupled directly to the container back bottom component, wherein the container back panel comprises at least one back coupling mechanism located to selectively engage with the at least one front coupling mechanism, and a container lid component hingedly coupled to the container back panel, wherein the container lid component comprises at least one lid closure feature, said at least one lid closure feature configured to removably couple to the at least one front closure feature, wherein the container front panel, container front bottom component, container back panel, and container back panel component are molded from the single plastic mold having a seamless molded structure between each panel and each component, and further wherein the container front panel, container from bottom component, container back panel, and container back panel component are configured to create an internal cavity of the plastic container when the front coupling mechanism is engaged with the back coupling mechanism; and a plurality of writing utensils including at least one of crayons, pencils, markers, chalk or pens;

a disposable container holding the plurality of writing utensils in an upright orientation therein, wherein an exterior surface of the disposable container is configured to be positioned directly adjacent the internal cavity of the plastic container; and an integral hinge component formed by a molded material having a lower density than an adjacent molded material extending between the container back panel and the container lid, such that the container lid is pivotal about the integral hinge component toward the container front panel into a closed position and is pivotal away from the container front panel into an open position, wherein, in the closed position, the front closure feature engages with the lid closure feature, retaining the container lid in the closed configuration until the front closure feature is disengaged from the lid closure feature, wherein at least one of the front closure feature and the lid closure feature is a protrusion and wherein at least one of the front closure feature and the lid closure feature is a protrusion receptacle formed into or through at least one of the container lid component and the container front panel.

15. The writing utensil containing kit of claim 14, further comprising an integral hinge component formed by a molded seam portion extending between the front bottom component and the back bottom component, such that the container front panel and the front bottom component are pivotal away from the container back panel and back bottom component into a loading configuration for loading the disposable container therein and are pivotal toward the container back panel and back bottom component into a retaining configuration for rerating the disposable container loaded therein between the container front panel and the container back panel.

16. The writing utensil containing kit of claim 15, wherein, in the retaining configuration, the front coupling mechanism and the back coupling mechanism engage with each other preventing pivoting of at least one of the container front panel and the container back panel about the integral hinge component, wherein when the front coupling mechanism and the back coupling mechanism are selectively disengaged from an interlocked configuration, at least one of the container front panel and the container back panel is operable to pivot away from each other form the retaining configuration to the loading configuration.

17. The writing utensil containing kit of claim 14, further comprising at least one of an indention and a protrusion molded in association with the container back panel and at least one of a protrusion and an indention molded in association with the container lid and aligned such that the at least one of the indention and the protrusion of the container back panel is selectively engagable with the at least one of the protrusion and the indention of the container lid when the lid is in an open position.

* * * * *